US012781998B2

(12) United States Patent
Keum et al.

(10) Patent No.: US 12,781,998 B2
(45) Date of Patent: Nov. 3, 2026

(54) HUMIDIFIER

(71) Applicant: LG ELECTRONICS INC., Seoul (KR)

(72) Inventors: Kyoha Keum, Seoul (KR); Myungjin Ku, Seoul (KR); Kyunglok Cho, Seoul (KR); Junehee Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 361 days.

(21) Appl. No.: 18/647,081

(22) Filed: Apr. 26, 2024

(65) Prior Publication Data

US 2024/0361036 A1 Oct. 31, 2024

(30) Foreign Application Priority Data

Apr. 27, 2023 (KR) ..... 10-2023-0055144

(51) Int. Cl.
*F24F 13/20* (2006.01)
*F24F 6/12* (2006.01)
*F24F 6/00* (2006.01)

(52) U.S. Cl.
CPC ..... *F24F 13/20* (2013.01); *F24F 6/12* (2013.01); *F24F 2006/008* (2013.01); *F24F 2221/02* (2013.01)

(58) Field of Classification Search
CPC ..... F24F 6/12; F24F 13/20; F24F 2006/008; F24F 2221/02; F24F 2221/26
See application file for complete search history.

(56) References Cited

U.S. PATENT DOCUMENTS 5,322,646 A * 6/1994 Wright ..... F24F 6/12 261/79.2
6,301,433 B1 * 10/2001 Montagnino ..... B05B 17/0615 392/405

(Continued)

FOREIGN PATENT DOCUMENTS

CN 106705316 5/2017
CN 111550884 8/2020

(Continued)

OTHER PUBLICATIONS

English Machine Translation of KR 20150056422 A (Year: 2015).*

(Continued)

*Primary Examiner* — Charles S Bushey
(74) *Attorney, Agent, or Firm* — KED & ASSOCIATES, LLP

(57) ABSTRACT

A humidifier includes a case; a humidifying device which is disposed inside the case and generates humidified air; a light source which is disposed inside the case, and emits light; and a light diffuser which diffuses the light emitted from the light source, wherein the case includes: a peripheral wall; and a discharge flow path which extends in an up-down direction from an inner side of the peripheral wall, and is located in an upper side of the humidifying device, wherein in the peripheral wall, at least a portion corresponding to a vertical location of the discharge flow path is transparent, wherein the light source is disposed in a lower side of the discharge flow path, and wherein the light diffuser is disposed between the light source and the discharge flow path and extends downward in a center direction of the case.

20 Claims, 28 Drawing Sheets

(56) References Cited

U.S. PATENT DOCUMENTS

| | | | | |
|---|---|---|---|---|
| 8,940,085 | B2 | 1/2015 | Markham et al. | |
| 11,835,256 | B1 * | 12/2023 | Li | F21V 33/0044 |
| 2003/0169588 | A1 * | 9/2003 | Kohn | F21V 33/0088 362/253 |
| 2010/0133707 | A1 | 6/2010 | Huang | |
| 2012/0222548 | A1 * | 9/2012 | Lev | F24F 6/12 261/119.1 |
| 2013/0154134 | A1 | 6/2013 | Lev | |
| 2022/0168538 | A1 * | 6/2022 | Liu | A61L 2/10 |
| 2024/0200800 | A1 * | 6/2024 | Choi | F24F 6/025 |
| 2024/0361015 | A1 * | 10/2024 | Ku | F24F 6/12 |
| 2024/0361030 | A1 * | 10/2024 | Jeong | F24F 11/0008 |
| 2024/0361037 | A1 * | 10/2024 | Ku | F24F 8/10 |

FOREIGN PATENT DOCUMENTS

| | | | |
|---|---|---|---|
| CN | 114857703 | | 8/2022 |
| CN | 217685275 U | * | 10/2022 |
| JP | H05-340574 | | 12/1993 |
| JP | 2009-162387 | | 7/2009 |
| JP | 2009-275925 | | 11/2009 |
| JP | 2014-202408 | | 10/2014 |
| JP | 7128599 B1 | * | 8/2022 |
| KR | 10-1346651 | | 1/2014 |
| KR | 10-2015-0049012 | | 5/2015 |
| KR | 1020150056422 A | * | 5/2015 |
| KR | 10-2018-0124370 | | 11/2018 |
| KR | 1020190063522 A | * | 6/2019 |
| KR | 10-2020-0036311 | | 4/2020 |
| KR | 10-2022-0067071 | | 5/2022 |
| KR | 10-2500340 | | 2/2023 |
| WO | WO 2022/085871 | | 4/2022 |
| WO | WO 2023120626 A1 | * | 6/2023 |

OTHER PUBLICATIONS

English Machine Translation of KR 20190063522 A (Year: 2019).*
English Machine Translation of JP 7128599 B1 (Year: 2022).*
English Machine Translation of CN 217685275 U (Year: 2022).*
English Machine Translation of WO 2023120626 A1 (Year: 2023).*
Extended European Search Report dated Sep. 13, 2024 issued in Application No. 24172306.3.
U.S. Appl. No. 18/647,081, filed Apr. 26, 2024.
U.S. Appl. No. 18/647,399, filed Apr. 26, 2024.
European Search Report dated Sep. 25, 2024, on European Patent appl. No. 24172346.9.

* cited by examiner (a)

(b)

HUMIDIFIER

CROSS-REFERENCE TO RELATED APPLICATION(S)

This application claims priority under 35 U.S.C. § 119 to Korean Application No. 10-2023-0055144, filed in Korea on Apr. 27, 2023, whose entire disclosure(s) is/are hereby incorporated by reference.

BACKGROUND

1. Field

This disclosure relates to a humidifier, and more particularly, to a humidifier that radiates light to a flowing humidified air.

2. Background

A humidifier is a device that vaporizes water and emits humidified air with a high moisture content. A humidifier can generate humidified air by evaporating water through processes that include one or more of natural evaporation, heated evaporation, or ultrasonic vibration.

An 'upward discharge type large-capacity humidifier' disclosed in Korean Patent No. 10-2500340 may include a water tank for storing water; a main body that is disposed in a lower side of the water tank and has a discharge hole formed in an upper side; a vibrator disposed on the inner bottom surface of the main body; and a lamp that is disposed at the center of the bottom surface of the main body and emits light. For example, the light from the lamp may pass through a light transmitting plate disposed on an outer circumferential surface of the main body.

In this and other conventional humidifiers, light may be emitted from a lamp disposed inside the main body and may be directly transmitted toward occupants in the indoor space through a light transmitting plate. In addition, since light may be emitted directly to the occupants from a point light source, the light may disturb the occupants' sleep at night and makes their vision uncomfortable. In addition, since the lamp may be disposed on the bottom surface of the main body and may pass through water before being emitted from the humidifier, the light emitted from the lamp may not spread in a desired manner. In addition, since the lamp may be submerged in water stored in the main body, light from the lamp may not illuminate the discharged humidified air, and the light transmitting plate and a discharge flow path may be spaced apart from each other, so that it may be difficult for a user to visually examine the operating state of the humidifier from a distance. In addition, since the light transmitting plate may be applied only to a portion of the main body of the humidifier, a user may check the operating state of the humidifier when correctly positioned to view that portion of the main body.

The above reference is incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
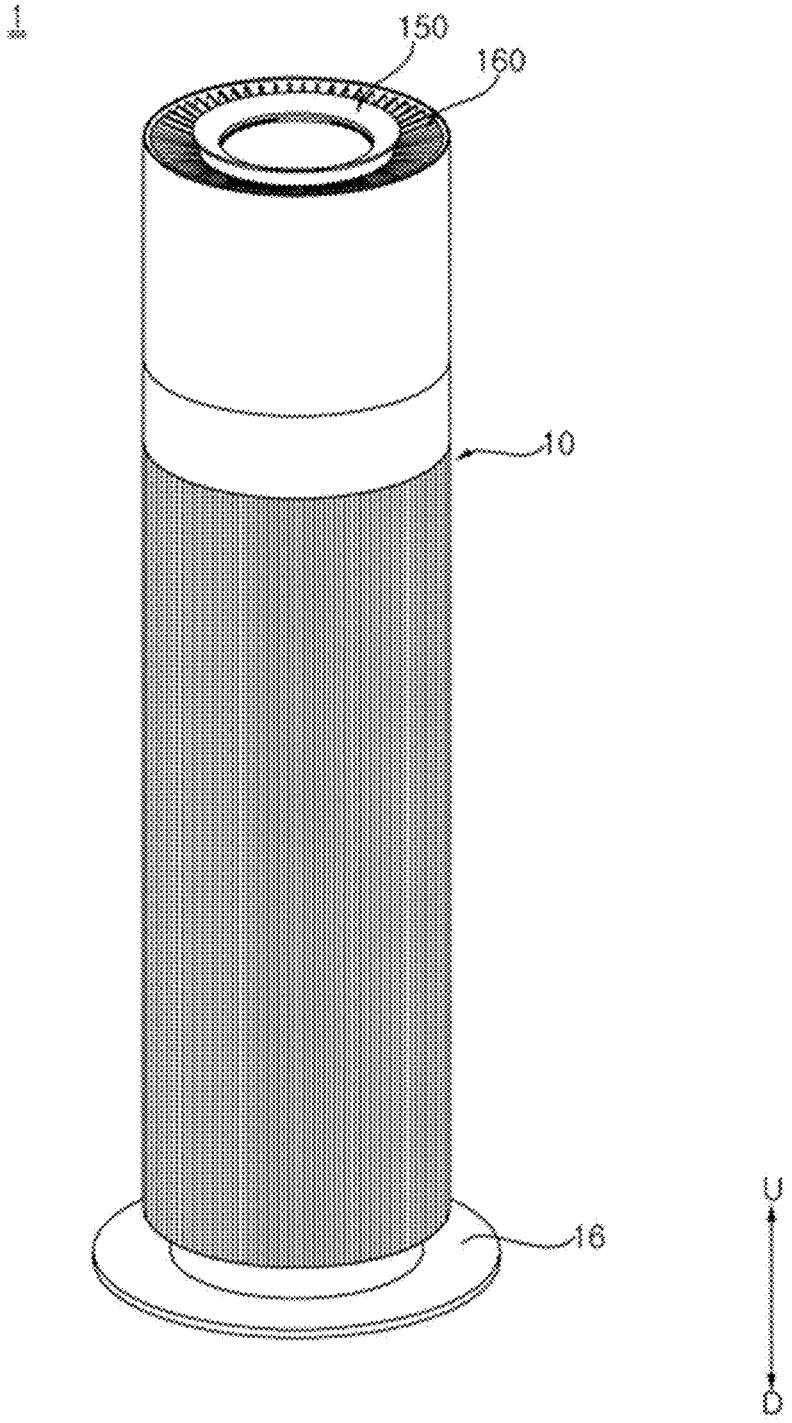
FIG. 1 is a perspective view of a humidifier according to an embodiment.

Description will now be given in detail according to exemplary embodiments disclosed herein, with reference to the accompanying drawings. For the sake of brief description with reference to the drawings, the same or equivalent components may be denoted by the same reference numbers, and description thereof will not be repeated.

In general, suffixes such as "module" and "unit" may be used to refer to elements or components. Use of such suffixes herein is merely intended to facilitate description of the specification, and the suffixes do not have any special meaning or function.

In the present disclosure, that which is well known to one of ordinary skill in the relevant art has generally been omitted for the sake of brevity. The accompanying drawings are used to assist in easy understanding of various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are only used to distinguish one element from another.

It will be understood that when an element is referred to as being "connected with" another element, there may be intervening elements present. In contrast, it will be understood that when an element is referred to as being "directly connected with" another element, there are no intervening elements present.

A singular representation may include a plural representation unless context clearly indicates otherwise. In the present application, it should be understood that the terms "comprises, includes," "has," etc. specify the presence of features, numbers, steps, operations, elements, components, or combinations thereof described in the specification, but do not preclude the presence or addition of one or more other features, numbers, steps, operations, elements, components, or combinations thereof. The direction indications of up (U), down (D), left (Le), right (Ri), front (F), rear (R), and outside (O) shown in the drawing are only for convenience of explanation, and the technical concept disclosed in this specification is not limited thereto.

Referring to FIG. 1, a humidifier 1 in an embodiment may include a case 10, a stand 16, a discharge grill 160, and a water tank cover 150. The case 10 may form an outer shape of the humidifier 1. The case 10 may extend relatively longer in the up-down, vertical direction. For example, the case 10 may have a cylindrical shape extending relatively longer in the up-down direction. The case 10 may define an internal space. A humidifying device 200, which will be described later, may be disposed in the internal space of the case 10.

The case 10 may include a suction hole 310 (see FIG. 2) through which air may be drawn into the case 10. The suction hole may be a through hole formed in the case 10. The suction hole 310 may be formed in a side surface of the case 10. The suction hole 310 may be formed in a circumferential surface of other region of the case 10. For example, the suction hole 310 may be a through hole formed in a circumferential side surface of the cylindrical case 10.

The case 10 may include a discharge hole 1600 (see FIG. 2) through which air is exhausted from case 10. The humidified air may be supplied to an indoor space through the discharge hole 1600 of the case 10. The upper side of the case 10 may be open, and the discharge hole 1600 may be an opening formed in the upper side of the case 10. For example, the discharge hole 1600 may be an annular discharge hole opened in the upper surface of the cylindrical case 10. The indoor air flowing into the case 10 through the suction hole may be discharged through the discharge hole 1600, together with humidified air.

The humidifier 1 may include a stand (or base) 16 that supports the case 10. The stand 16 may be disposed in a lower side of the case 10. The stand 16 may be fixed to the case 10. The stand 16 may be configured to prevent the case 10 from falling. For example, a diameter of the stand 16 may be larger than a diameter of the case 10. Accordingly, an outer circumference of the stand 16 may be located outside the peripheral wall of the case 10 in the horizontal direction. In another example, the stand 16 may be weighted.

The discharge grill 160 may be disposed in case 10 to cover the discharge hole 1600. The discharge grill 160 may be disposed in the open upper side of the case 10. The discharge grill 160 may be disposed in the discharge hole. The discharge grill 160 may form the upper surface of the case 10. Humidified air and air discharged from the humidifier 1 may pass through the discharge grill 160 and be supplied to the indoor space. For example, the discharge grill 160 may include vanes or other structures to direct outward air flow from the humidifier 1.

The water tank cover 150 may be disposed on the open upper side of the case 10. The water tank cover 150 may be disposed at the center of the discharge grill 160. The discharge grill 160 may be disposed around at least a portion or otherwise around an outside of the water tank cover 150. The water tank cover 150 may cover the water tank 110 (see FIG. 2) to store water, described later. The water tank cover 150 may be a lid of the water tank 110. The water tank cover 150 may be removably attached to the discharge grill 160. For example, a user may supply water to the water tank 110 by separating the water tank cover 150 from the discharge grill 160. After supplying water, a user may couple the water tank cover 150 to the discharge grill 160 to close the water tank 110.

Figure 2:
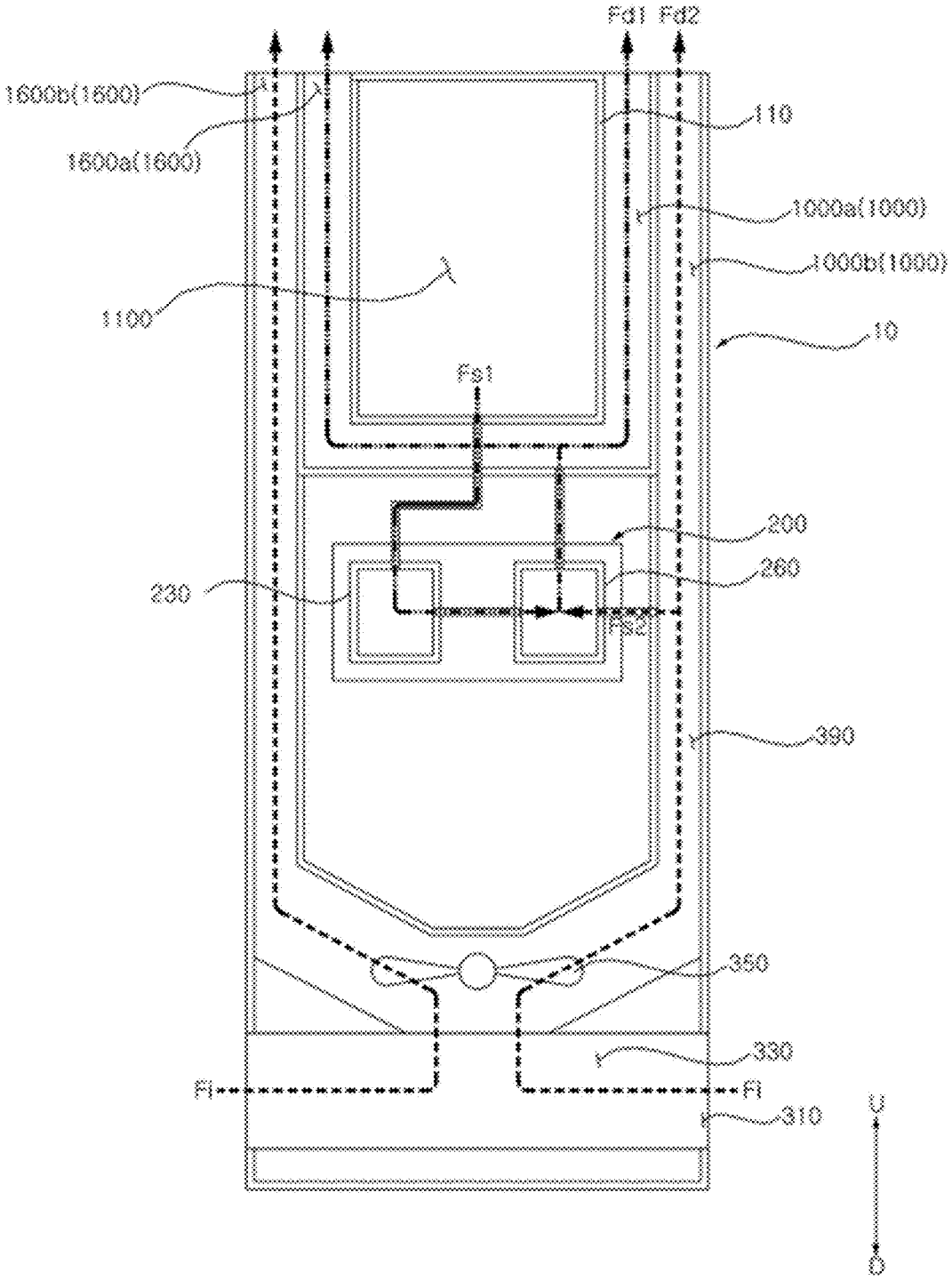
FIG. 2 is a schematic diagram of a humidifier according to an embodiment.

Referring to FIG. 2, the humidifier 1 in an embodiment may include the case 10, the water tank 110, a humidifying device 200, and a blowing fan 350. The indoor air may be sucked-in and flow into the humidifier 1 through a suction hole 310 formed in the case 10 (Fi). The suction hole 310 may be formed in a lower portion of the case 10. The air flowing into the inside of the case 10 may flow through the flow path formed therein (Fi). The air flowing inside the case 10 may be discharged back to the indoor space through the discharge hole 1600 formed in the upper side (Fi). A humidity of the discharged air may be higher than the humidity of the sucked-in air.

The water tank 110 may store water. The water tank 110 may include a water storage space 1100 in which water is stored. The water stored in the water storage space 1100 may be supplied to the humidifying device 200 (Fs1). The humidifying device 200 can generate humidified air using the supplied water from the water tank 110.

The humidifying device 200 may generate humidified air. Humidified air may include mist (e.g., water droplets) and/or water vapor (e.g., evaporated water). That is, humidified air may refer to air including mist and/or water vapor. The humidity of the humidified air may be higher than the humidity of indoor air.

In certain examples, the humidifying device 200 may include a heating water tank 230. Water supplied from the water tank 110 may flow into the heating water tank 230 (Fs1). The heating water tank 230 may heat the water supplied from the water tank 110. The heating water tank 230 may sterilize the supplied water by heating it. The heating water tank 230 may evaporate at least some of the supplied water by heating it.

The humidifying device 200 may include a humidifying water tank 260. The water sterilized in the heating water tank 230 may move to the humidifying water tank 260 (Fs1). The humidifying water tank 260 may utilize sterilized water supplied from the heating water tank 230 to generate humidified air. The humidifying water tank 260 may generate humidified air by using any one of an ultrasonic method, a heating method, an evaporation method, and a disk method. For example, the humidifying water tank 260 may generate humidified air by atomizing the supplied water by using an ultrasonic vibrator.

The blowing fan (or blower) 350 may be disposed inside the case 10. The blowing fan 350 may include, for example, in impeller to move air when rotated, and a motor to move the impeller. The blowing fan 350 may be disposed under or in a lower portion of the humidifying device 200. The blowing fan 350 may form an air current that flows inside the case. The blowing fan 350 may form an upward airflow flowing from the suction hole 310 to the discharge hole 1600 (Fi). For example, the blowing fan 350 may form a rising airflow that flows from the suction hole 310 formed in the lower portion of the case 10 to the discharge hole 1600 formed in the upper surface of the case 10.

The case 10 may include a blowing flow path (or blowing flow conduit) 390. The blowing flow path 390 may be formed inside the case 10. The blowing flow path 390 may be a flow path through which air blowing from the blowing fan 350 flows. The air including into housing 10 through the suction hole 310 may flow to the blowing fan 350 through a suction flow path 330 (Fi). The air passed by the blowing fan 350 may flow then into the blowing flow path 390 (Fi).

The case 10 may include at least one discharge flow path 1000. The discharge flow path 1000 may be formed inside the case 10. The air passed through the blowing flow path 390 may flow to the discharge flow path 1000 (Fd). The discharge flow path 1000 may be located at an upper side of the blowing flow path 390. The discharge flow path 1000 may be located downstream of the blowing flow path 390.

The discharge flow path 1000 may include a first discharge flow path 1000*a* and a second discharge flow path 1000*b*. The discharge hole 1600 may include a first discharge hole 1600*a* corresponding to the first discharge flow path 1000*a*, and a second discharge hole 1600*b* corresponding to the second discharge flow path 1000*b*. The second discharge flow path 1000*b* may be formed radially inside of the case 10. The first discharge flow path 1000*a* may be formed radially inside of the second discharge flow path 1000*b*.

The second discharge flow path 1000*b* may be connected to the blowing flow path 390. The second discharge flow path 1000*b* may be located downstream of the blowing flow path 390. Some of the air passed through the blowing flow path 390 may rise through the second discharge flow path 1000*b* (Fd2). The air that passed through the second discharge flow path 1000*b* may bypass the humidifying device 200 and be supplied to the indoor space through the second discharge hole 1600*b* (Fd2) without humidification.

A remaining portion of the air that passed through the blowing flow path 390 may flow into the humidifying device 200 (Fs2). For example, some of the remaining portion of the air passed through the blowing flow path 390 may flow into the humidifying water tank 260 (Fs2). This remaining portion of the air flowing into the humidifying water tank 260 may flow into the first discharge flow path 1000*a* along with the humidified air generated in the humidifying water tank 260 (Fd1). Humidified air flowing through the first discharge flow path 1000*a* may be supplied to the indoor space through the first discharge hole 1600*a* (Fd1).

Figure 3:
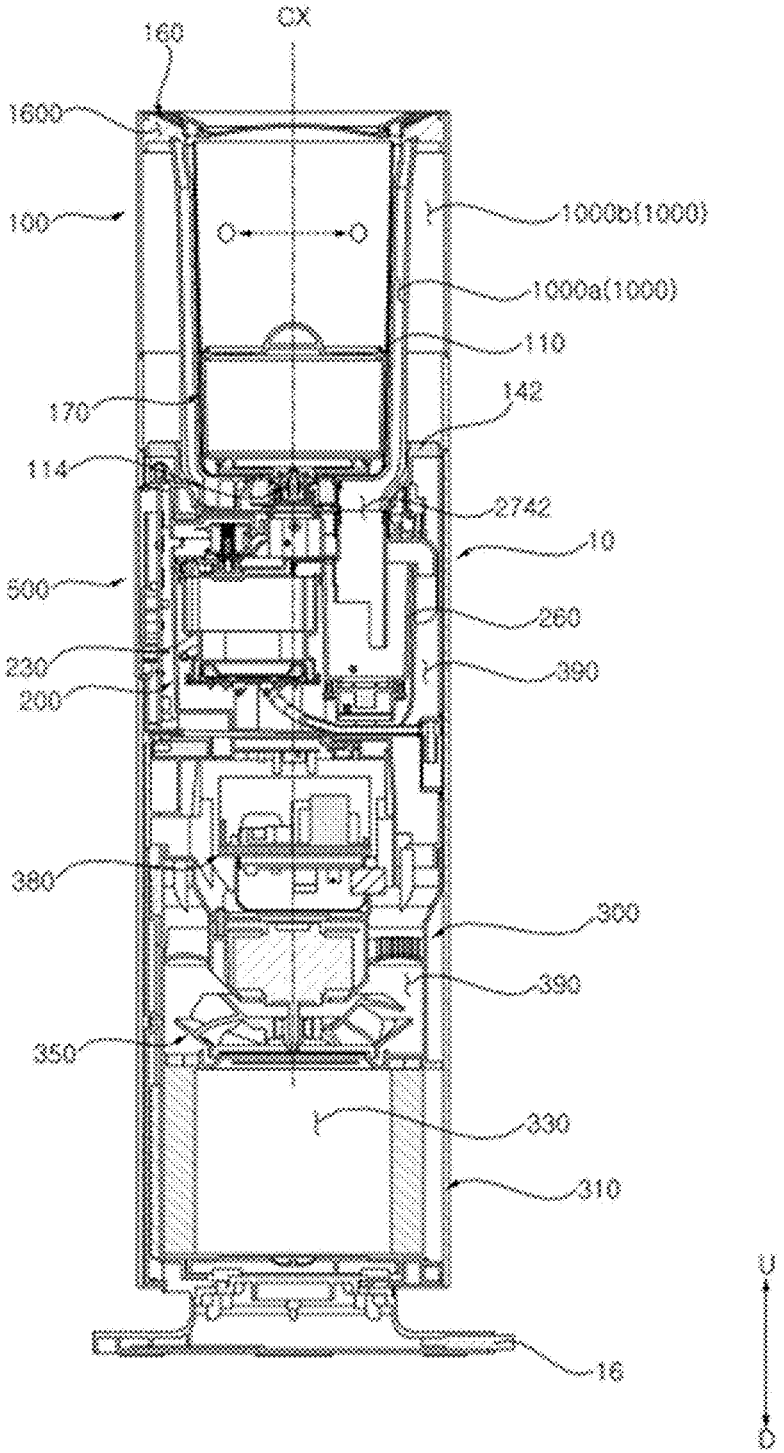
FIG. 3 is a longitudinal cross-sectional view of a humidifier according to an embodiment.

Referring to FIG. 3, the humidifier 1 in an embodiment may include a blower 300, a humidifying device 200, a flow path unit 100, a display 500, and an electrical equipment unit 380. The blower 300 may form an airflow and may include the fan 350. The blower 300 may be disposed inside the case 10. The blower 300 may form an airflow flowing inside the case 10. The blower 300 may flow indoor air into the case 10 through the suction hole 310. The blower 300 may blow the sucked-in air to the humidifying device 200 and/or to the flow path unit 100. The blower 300 may form an airflow that pulls the humidified air generated by the humidifying device 200 out of case 10. The blower 300 may provide an output flow to move and discharge humidified air generated by the humidifying device 200 to the indoor space.

As previously described, the humidifying device 200 may generate humidified air. The humidifying device 200 may be disposed inside the case 10. The humidifying device 200 may be disposed in the upper side of the blower 300. The humidifying device 200 may discharge humidified air. The rising airflow formed from the blower 300 may be directed to the humidifying device 200 through the blowing flow path 390. The rising airflow may pull the humidified air generated by the humidifying device 200 upward. The humidified air may be discharged through the discharge hole 1600 along with an upward airflow.

A flow path unit 100 may include a flow path through which air is discharged out of the housing 10. The flow path unit 100 may include a discharge flow path 1000. The discharge flow path 1000 may include a first discharge flow path 1000*a* and a second discharge flow path 1000*b*. Humidified air generated by the humidifying device 200 may flow to the first discharge hole 1600*a* through the first discharge flow path 1000*a*. Humidified air may be supplied to the indoor space through the first discharge hole 1600*a*. A portion of the air flowing in the blowing flow path 390 may bypass the humidifying device 200 and may flow to the second discharge hole 1600*b* through the second discharge flow path 1000*b*. The portion of unhumidified air may be supplied to the indoor space through the second discharge hole 1600*b*.

The display 500 may display information on the humidifier 1. The display 500 may include an output unit that displays information on the humidifier 1 to a user. Information on the humidifier 1 may include status information, such as the level of water stored in the water tank 110, the amount of humidification discharged, the temperature and humidity of the indoor space, the quality of air in the indoor space, the concentration of fine dust in the indoor space, and the like. In another example, the display 500 may output light of different colors that vary according to a status of a humidifier 1, such as to output light of a first color when the humidifier 1 is operating, light a second color when the humidifier 1 is inactive, and light of a third color when the water tank 110 is empty. The display 500 may include an input unit through which a user's command is input. A user may control the operation of the humidifier 1 through the display 500. For example, a user may control the humidification amount, air volume, operation time, turn on-off of lighting, the intensity of lighting, etc. through the display 500. The input unit may include a touchscreen, buttons, or other known input devices.

The electrical equipment unit (or controller) 380 may transmit and receive electrical signals. The electrical equipment unit 380 may control the operation of the humidifier 1. The electrical equipment unit 380 may control the power supplied to the humidifier 1. In one example, the electrical equipment unit 380 may include a central processing unit (CPU) or include one or more printed circuit boards (PCBs). In another example, the electrical equipment unit 380 may include an interface to communicate with a separate device, such as a computing or user device coupled to the humidifier through a wired or wireless connection.

Figure 4:
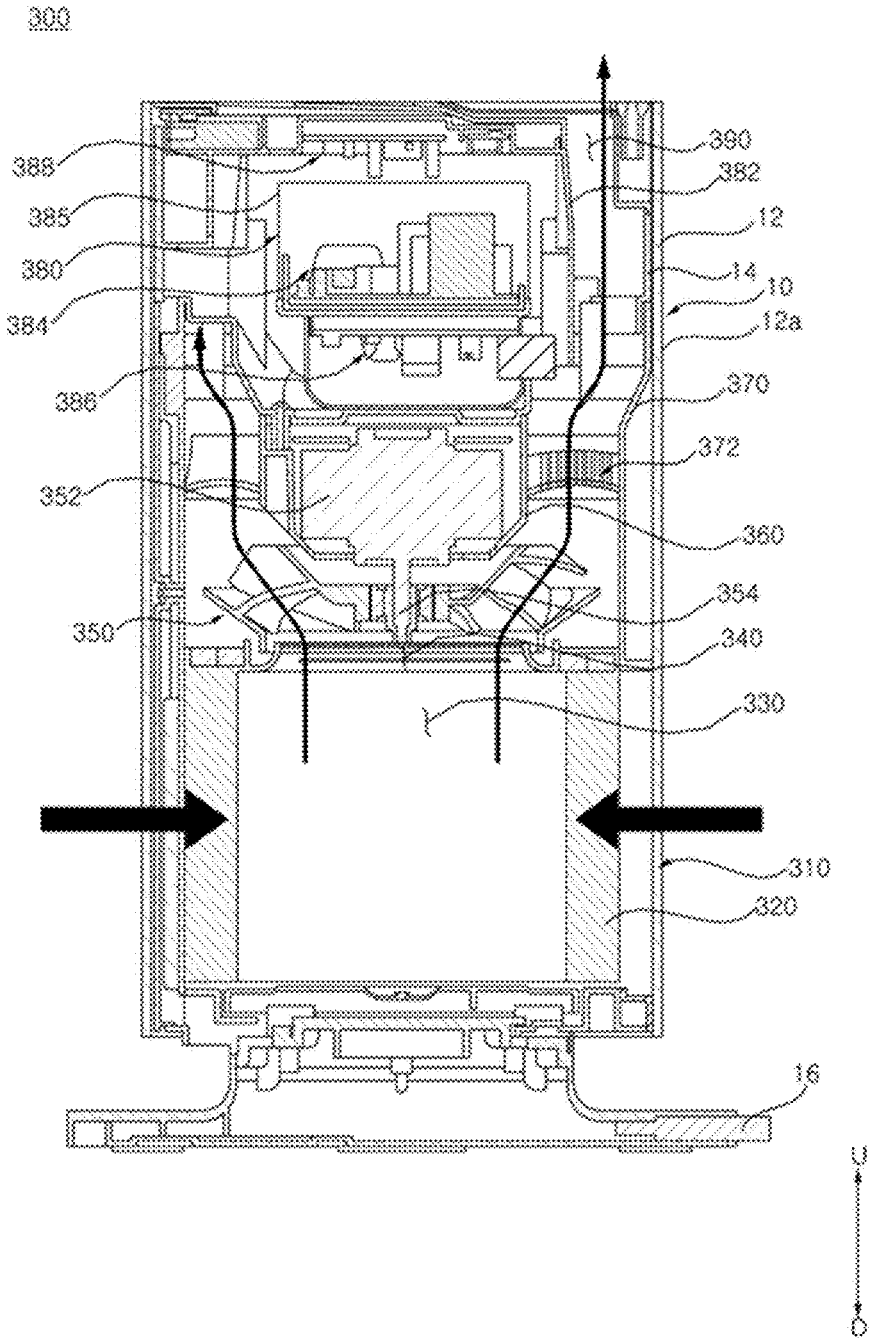
FIG. 4 is a longitudinal cross-sectional view of a blowing device of a humidifier according to an embodiment.

Referring to FIG. 4, the blower 300 in an embodiment of humidifier 1 may include a filter 320, the blowing fan 350, and a blower motor 352. The indoor air may be sucked into the blower 300 through the suction hole 310 formed in the case 10. The blower 300 may include a filter 320 that filters the sucked air. The filter 320 may be disposed inside the case 10. For example, the filter 320 may be disposed inside the cylindrical case 10, and may be formed in a cylindrical or other shape to be received in case 10. The air passed through and filtered by the filter 320 may flow to the blowing fan 350 through the suction flow path 330. The suction flow path 330 may be formed inside the filter 320.

The blower 300 may include an orifice 340 located between the blowing fan 350 and the filter 320. The orifice 340 may be a hole through which the sucked air passes. The orifice 340 may be located between the suction flow path 330 and the blowing flow path 390. The orifice 340 may communicate with the suction flow path 330 and the blowing flow path 390. The orifice 340 may correspond to an inlet to the blowing fan 350. For example, the orifice 340 may correspond to the inlet formed in a shroud of the blowing fan 350. The suctioned air may flow from the suction flow path 330 to the blowing fan 350 through the orifice 340, and may flow to the blowing flow path 390 by rotation of the blowing fan 350.

The blower 300 may include a blower motor 352 that rotates the blowing fan 350. The blower motor 352 may be connected to the blowing fan 350. For example, a shaft 354 of the blower motor 352 may be connected to the blowing fan 350. The blower motor 352 may be disposed in the upper side of the blowing fan 350. The shaft 354 may extend downward from the blower motor 352, and may be connected to a hub of the blowing fan 350. As the blower motor 352 is driven, the blowing fan 350 rotates to form an airflow.

The blower 300 may include a motor cover 360 in which the blower motor 352 is disposed. The blower motor 352 may be accommodated in the motor cover 360. Inside the motor cover 360, the blower motor 352 may be disposed, and the blowing fan 350 may be disposed outside the motor cover 360. For example, the blowing fan 350 may be disposed in the lower side of the motor cover 360. The shaft 354 of the blower motor 352 may penetrate the motor cover 360.

The blower 300 may include a blower housing 370 that forms a blowing flow path 390. The blower housing 370 may be disposed inside the case 10. The blowing fan 350 and the blower motor 352 may be disposed inside the blower housing 370. The blowing flow path 390 may be formed between the motor cover 360 and the blower housing 370. The blower housing 370 may extend in the up-down, vertical direction.

The case 10 may include an inner case 14 and an outer case 12. The outer case 12 may form the outer shape of the case 10. The outer case 12 may include a plurality of louvers 12*a*. The plurality of louvers 12*a* may be disposed along the circumference of the outer case 12. The inner case 14 may be disposed inside the outer case 12. The inner case 14 may be disposed in the upper side of the blower housing 370. For example, the inner case 14 and the blower housing 370 are disposed inside the outer case 12, and the inner case 14 may be coupled to the upper side of the blower housing 370.

The blowing flow path 390 may be formed inside the case 10. The blowing flow path 390 may extend in the up-down direction inside the case 10. The blowing flow path 390 may have an annular cross-section. The blowing flow path 390 may be located in the downstream side of the blowing fan 350. The blowing fan 350 may be located between the suction flow path 330 and the blowing flow path 390. The motor cover 360 may be disposed inside the blower housing 370. The blowing flow path 390 may be formed between the motor cover 360 and the blower housing 370.

The electrical equipment unit 380 may be disposed in the upper side of the blower motor 352. The electrical equipment unit 380 may be disposed inside the inner case 14. A blowing flow path 390 may be formed between the electrical equipment unit 380 and the inner case 14. Accordingly, the sucked air may be directed to the humidifying device 200 along the blowing flow path 390 by the blowing fan 350.

The blower 300 may include an air diffuser 372 disposed in the blowing flow path 390. The air diffuser 372 may control the directionality of the airflow flowing in the blowing flow path 390. For example, the air diffuser 372 may straighten the airflow flowing through the blowing flow path 390. The air diffuser 372 may be disposed in the outside of the motor cover 360. The air diffuser 372 may be disposed inside the blower housing 370. In one example, a plurality of the air diffusers 372 may be disposed between the motor cover 360 and the blower housing 370, and the plurality of air diffusers 372 may be disposed to be spaced apart from each other in the circumferential direction of the cross section of the blowing flow path 390. A flow path may be formed between the plurality of air diffusers 372.

Referring to FIG. 4, the blower 300 in an embodiment of humidifier 1 may include an electrical equipment unit 380. The electrical equipment unit 380 may include a controller 388 that controls the operation of the humidifier 1. The controller 388 may control the turn on-off, operation time, humidification amount, turn on-off and intensity of lighting, etc. For example, the controller 388 may be a microcontroller (MCU).

The electrical equipment unit 380 may include a power supply device 384 that receives external power and supplies electrical energy to the humidifier 1. The power supply device 384 may supply electrical energy, for example, to the humidifying device 200, the blower 300, and/or the display 500. The power supply device 384 may include, for example, a rectifier to convert external AC power to DC power to drive components within the humidifier 1.

The electrical equipment unit may include a phase control device 386. The phase control device 386 may convert the voltage and current input to the humidifying device 200. For example, the phase control device 386 may convert the power input to the heater 250 of the water tank 230.

The electrical equipment unit 380 may include a communication device that transmits and receives data. The communication device may include a wireless communication device. The communication device may use wireless communication technologies such as Wi-Fi, Bluetooth, and cellular. The communication device may transmit and receive data to other devices.

The electrical equipment unit 380 may include a sensor that detects information on the indoor space. For example, the sensor may include at least one of a temperature sensor that detects the temperature of the indoor space and a humidity sensor that detects the humidity of the indoor space. For example, the electrical equipment unit 380 may include a thyristor that selectively operates at certain temperature ranges, such as to activate a warning light or to activate fan 350 when an internal temperature of humidifier 1 is above a particular threshold temperature.

Figure 5:
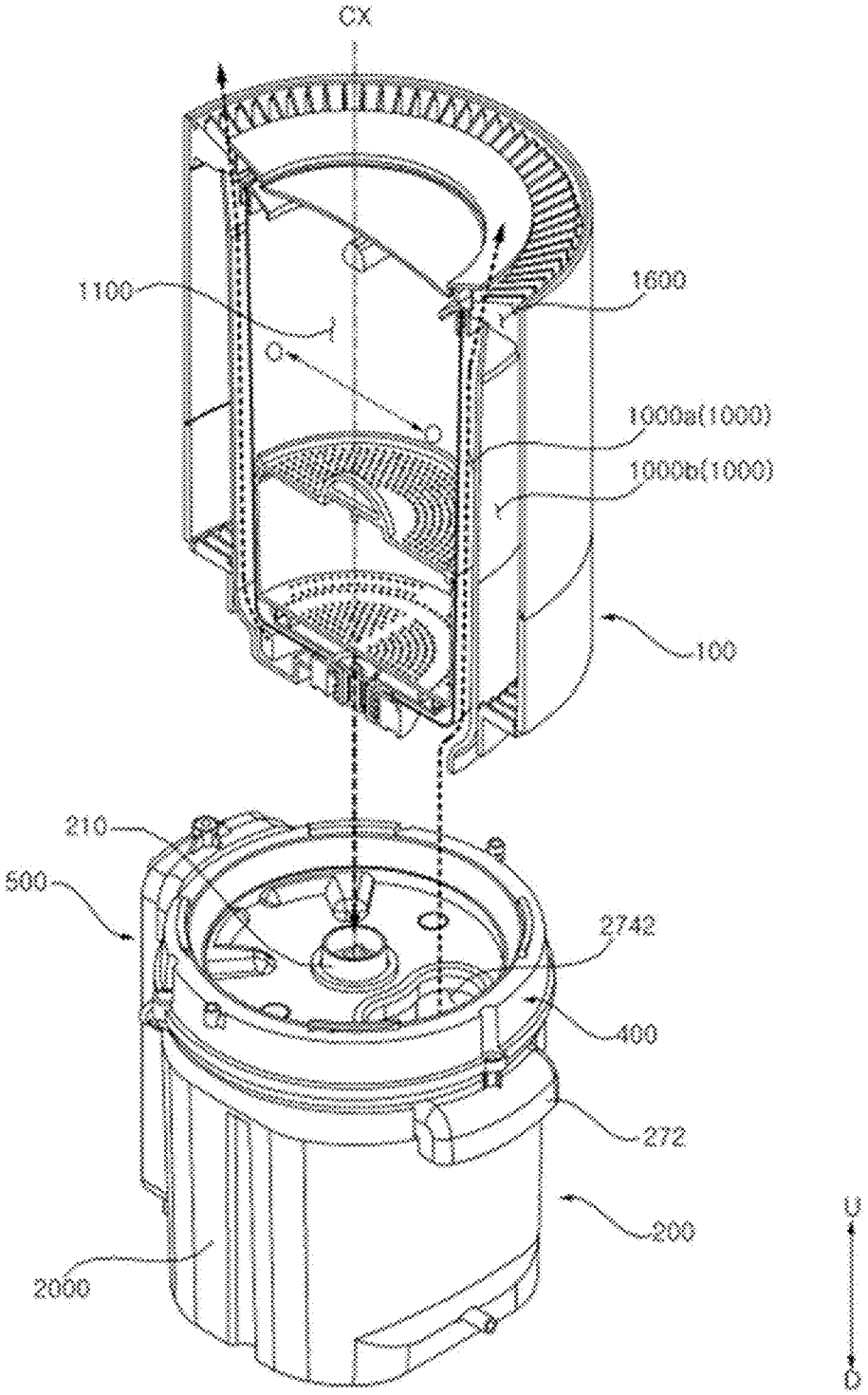
FIG. 5 is a diagram showing a humidifying device and a flow path unit of a humidifier according to an embodiment.

Referring to FIG. 5, humidified air discharged from the humidifying device 200 may be discharged through the flow path unit 100. The humidifying device 200 may include a main housing 2000, a supply pipe 210, and a humid air outlet 2742. The main housing 2000 may form the outer shape of the humidifying device 200.

Water stored in a water storage space 1100 defined in water tank 110 may flow into the humidifying device 200 through the supply pipe 210. The humidifying device 200 may generate humidified air by using water supplied through the supply pipe 210. The supply pipe 210 may be disposed in the upper side of the humidifying device 200. The supply pipe 210 may extend upward from an upper side of the humidifying device 200. For example, water stored in the water storage space 1100 located above the humidifying device 200 may flow in through the supply pipe 210 located in the upper side of the humidifying device 200.

Humidified air generated in the humidifying device 200 may be discharged through a humid air outlet 2742. The humid air outlet 2742 may be formed in the upper side of the humidifying device 200. The humid air outlet 2742 may be opened in the upper surface of the humidifying device 200.

The middle tray 400 may be disposed in the upper side of the humidifying device 200. The middle tray 400 may be coupled to the upper surface of the humidifying device 200. The middle tray 400 may be disposed between the humidifying device 200 and the flow path unit 100.

The display 500 may be disposed in one side of the humidifying device 200. The display 500 may be coupled to one side of a main housing 2000. The display 500 may be coupled to one side of the middle tray 400. For example, the middle tray 400 may be disposed above the humidifying device 200, and the display 500 may be disposed in the side surface of the humidifying device 200.

The flow path unit 100 may include a water storage space 1100, a discharge flow path 1000, and a discharge hole 1600. The water storage space 1100 may be formed inside the flow path unit 100. The water stored in the water storage space 1100 may be supplied to the humidifying device 200. For example, the water stored in the water storage space 1100 may flow into the humidifying device 200 through the supply pipe 210 located in below the water storage space 1100.

The discharge flow path 1000 may be located inside the flow path unit 100. The discharge flow path 1000 may be located outside the water storage space 1100. The discharge flow path 1000 may be located between the peripheral wall of the flow path unit 100 and the water storage space 1100. The discharge flow path 1000 may include the first discharge flow path 1000*a* located radially outside of the water storage space 1100, and a second discharge flow path 1000*b* located radially outside of the first discharge flow path 1000*a*. The first discharge flow path 1000*a* may be located between the water storage space 1100 and the second discharge flow path 1000*b*. The second discharge flow path 1000*b* may be located between the first discharge flow path 1000*a* and the peripheral wall of the flow path unit 100. In another example, the first discharge flow path 1000*a* and the second discharge flow path 1000*b* may be located between the water storage space 1100 and the peripheral wall of the flow path unit 100, and may be separated in a circumferential direction.

Humidified air discharged from the humidifying device 200 may flow through the discharge flow path 1000. For example, the humidified air discharged from the humid air outlet 2742 may flow through the first discharge flow path 1000*a*. Humidified air flowing through the first discharge flow path 1000*a* may be supplied to the indoor space through the discharge hole 1600. The first discharge flow path 1000*a* and the second discharge flow path 1000*b* may be joined at the discharge hole 1600. The first discharge flow path 1000*a* may be connected to the humid air outlet 2742. The second discharge flow path 1000*b* may be connected to the blowing flow path 390.

Figure 6:
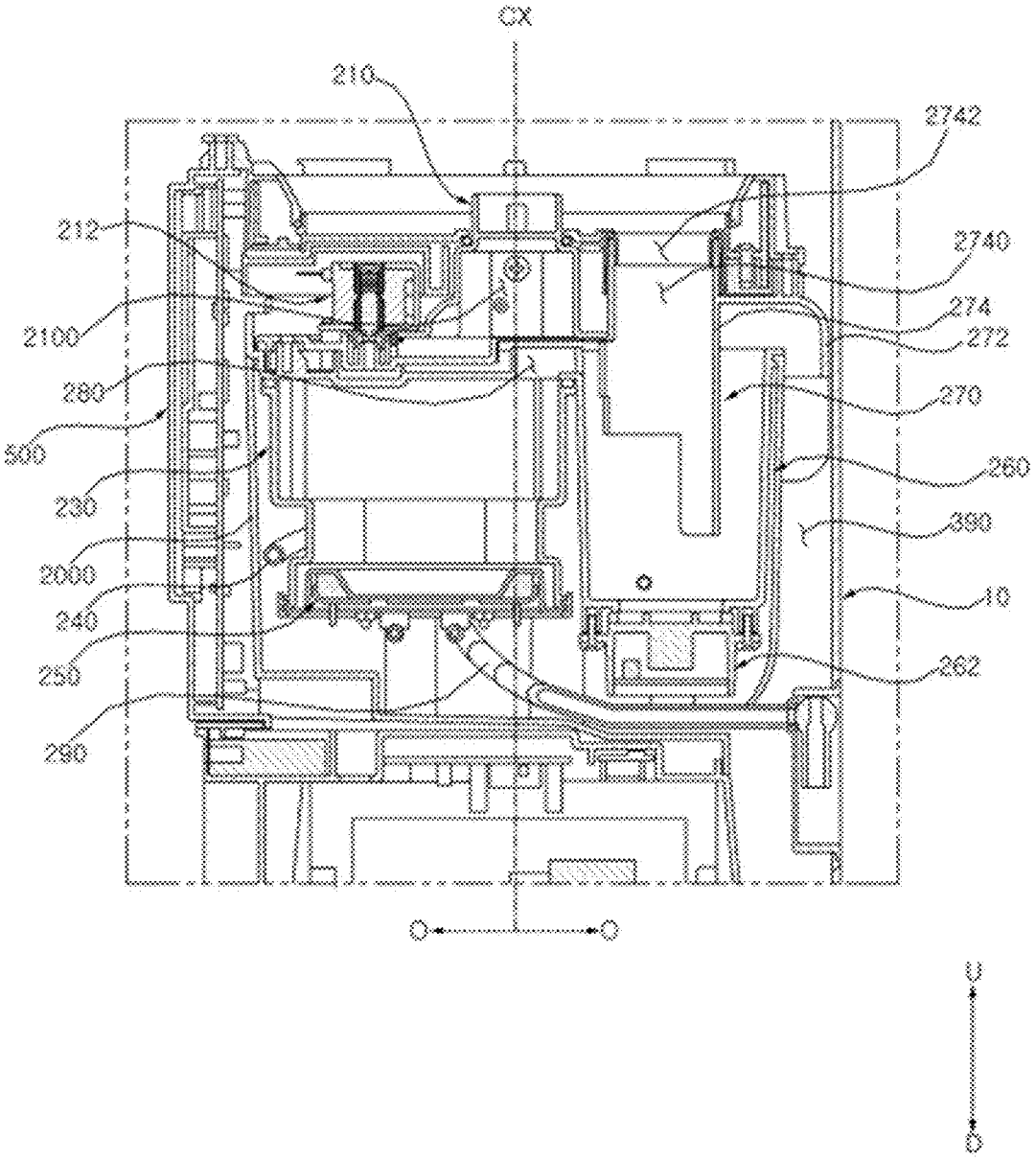
FIG. 6 is a longitudinal cross-sectional view of a humidifying device of a humidifier according to an embodiment.

Referring to FIG. 6, the humidifying device 200 in an embodiment of humidifier 1 may include the main housing 2000, a supply pipe 210, a first valve 212, a heating water tank 230, a first connection pipe 240, a drain pipe 290, a humidifying water tank 260, and a compartment cover 270.

The main housing 2000 may be disposed inside the case 10. The main housing 2000 may accommodate the heating water tank 230 and the humidifying water tank 260, which will be described later. The upper side of the main housing 2000 may be opened, such as to allow water to enter the humidifying device 200 and to allow humidified air to leave the humidifying device 200.

The supply pipe 210 may be a pipe through which water is supplied to the humidifying device 200. The supply pipe 210 may be connected to the humidifying device 200. The water stored in the water tank 110 may be supplied to the humidifying device through the supply pipe 210. For example, water stored in the water tank 110 may be moved to the heating water tank 230 through the supply pipe 210. A supply chamber 2100 may be formed inside or coupled to the supply pipe 210. The water flowing into the supply pipe 210 may pass through the supply chamber 2100 and flow into the heating water tank 230. The water flowing into the supply pipe 210 may be temporarily stored in the supply chamber 2100.

The first valve 212 may control the flow of water supplied to the humidifying device 200 through the supply pipe 210. For example, when the first valve 212 is opened, the water stored in the supply chamber 2100 may be moved to the heating water tank 230. Conversely, when the first valve 212 is closed, the supplied water may be temporarily stored in the supply chamber 2100. The first valve 212 may be opened and closed according to an electrical signal of the electrical equipment unit 380. The first valve 212 may be supplied with power from the electrical equipment unit 380. For example, the first valve 212 may be a solenoid valve. The first valve 212 may be disposed above the heating water tank 230. The first valve 212 may be disposed in or adjacent to the supply pipe 210. For example, the first valve 212 may be disposed between the heating water tank 230 and the supply pipe 210. The first valve 212 may be spaced upward from the heating water tank 230. For example, the first valve 212 may be spaced upward from the upper surface of the heating water tank 230.

The heating water tank 230 may be disposed inside the main housing 2000. The heating water tank 230 may heat water flowed in through the supply pipe 210. The heating water tank 230 may heat water to sterilize and/or evaporate the water. The sterilized water heated in the heating water tank 230 may flow to the humidifying water tank 260.

The first connection pipe 240 may be a pipe through which water stored in the heating water tank 230 flows to the humidifying water tank 260. The height of the first connection pipe 240 may decrease in a downstream direction. For example, the first connection pipe 240 may be inclined downward toward the downstream side. The first connection pipe 240 may have high thermal conductivity, such as to be constructed of a metal or other material of relatively high thermal conductivity. The temperature of water heated in the heating water tank 230 may decrease while flowing through the first connection pipe 240, such as due to the heat from the water being conducted into the first connection pipe while flowing away toward the humidifying water tank 260.

The drain pipe 290 may be connected to the heating water tank 230. The drain pipe 290 may discharge residual water stored in the heating water tank 230. The remaining water may be discharged to the outside of the case 10 through the drain pipe 290. The drain pipe 290 may be connected to the lower portion of the heating tank 230. For example, the drain pipe 290 may be connected to the bottom surface of the heating tank 230.

The humidifying water tank 260 may generate humidified air by using supplied water, such as sterilized water from heating water tank 230. Humidified air may refer to air containing mist and/or water vapor. The humidifying water tank 260 may generate humidified air by using any one of an ultrasonic method, a heating method, an evaporation method, and/or a disk method. For example, the humidifying water tank 260 may generate humidified air by atomizing supplied water by using an ultrasonic vibrator. The humidifying water tank may be equipped with a vibration device 262 that vibrates to atomize water into droplets carried on an air flow through the humidifying water tank 260.

The vibration device 262 may be disposed in or near the bottom surface of the humidifying water tank 260. The vibration device 262 may split the supplied water into fine particles by using ultrasonic vibration. The vibration device 262 may atomize supplied water electrically. For example, the vibration device 262 may include a piezoelectric element.

The compartment cover 270 may be disposed in the upper side of the main housing 2000. The compartment cover 270 may cover the upper side of the humidifying water tank 260. The compartment cover 270 may partition a flow path flowing into the humidifying water tank 260 and a flow path flowing out from the humidifying water tank 260. For example, the compartment cover 270 may include an air supply pipe 210 which is a flow path through which a portion of the rising airflow flowing through the blowing flow path 390 flows into the humidifying water tank 260, and a discharge pipe 274 through which a portion of the rising airflow flowing into the humidifying water tank 260 and the mist and water vapor in the humidifying water tank 260 are discharged together. The air supply pipe 210 may connect the blowing flow path 390 and the humidifying water tank 260. The rising airflow that flows into the humidifying water tank 260 through the blowing flow path 390 may flow by pulling the mist generated in the humidifying water tank 260. Through this, the mist generated in the humidifying water tank 260 may be discharged in an outward air flow. The discharge pipe 274 may extend in an up-down, vertical direction. The discharge pipe 274 may form a discharge flow path 2740. The humid air outlet 2742 may be formed at one end of the discharge pipe 274. A portion of the discharge pipe 274 may be inserted into the humidifying water tank 260.

The humidifying device 200 may include a communication flow path 280 that connects the heating water tank 230 and the humidifying water tank 260. The communication flow path 280 may connect the upper portion of the heating water tank 230 and the upper portion of the humidifying water tank 260. In the heating water tank 230, water vapor may be generated in the process of heating the supplied water. The generated water vapor may flow into the humidifying water tank 260 through the communication flow path 280. The discharge pipe 274 may be open toward the communication flow path 280. The communication flow path 280 may be connected to the discharge flow path 2740. Water vapor that moves from the heating water tank 230 to the humidifying water tank 260 through the communication flow path 280 may be discharged through the discharge pipe 274. Through this, the humidified air may include water vapor generated in the heating water tank 230, haze generated in the humidifying water tank 260, and a rising airflow formed by the blowing fan 350.

Referring to FIG. 6, the humidifier 1 may include the display 500. The display 500 may be disposed in one side of the humidifying device 200. The display 500 may be coupled to one side of the main housing 2000. For example, the display 500 may be coupled to the side surface of the humidifying device 200. The display 500 may be spaced apart from the humidifying water tank 260 in the horizontal direction. The display 500 may be spaced apart in the horizontal direction from the discharge pipe 274 through which humidified air generated in the humidifying water tank 260 is discharged. The supply pipe 210 may be disposed between the display 500 and the discharge pipe 274. For example, the display 500 and the discharge pipe 274 may be disposed in opposite sides in the horizontal direction based on the central axis of the case 10. For example, based on the central axis of the case 10, the display 500 may be disposed in the front surface of the case 10, and the wet air outlet 2742 may be disposed in the rear of case 10, opposite to the display 500.

Figure 7:
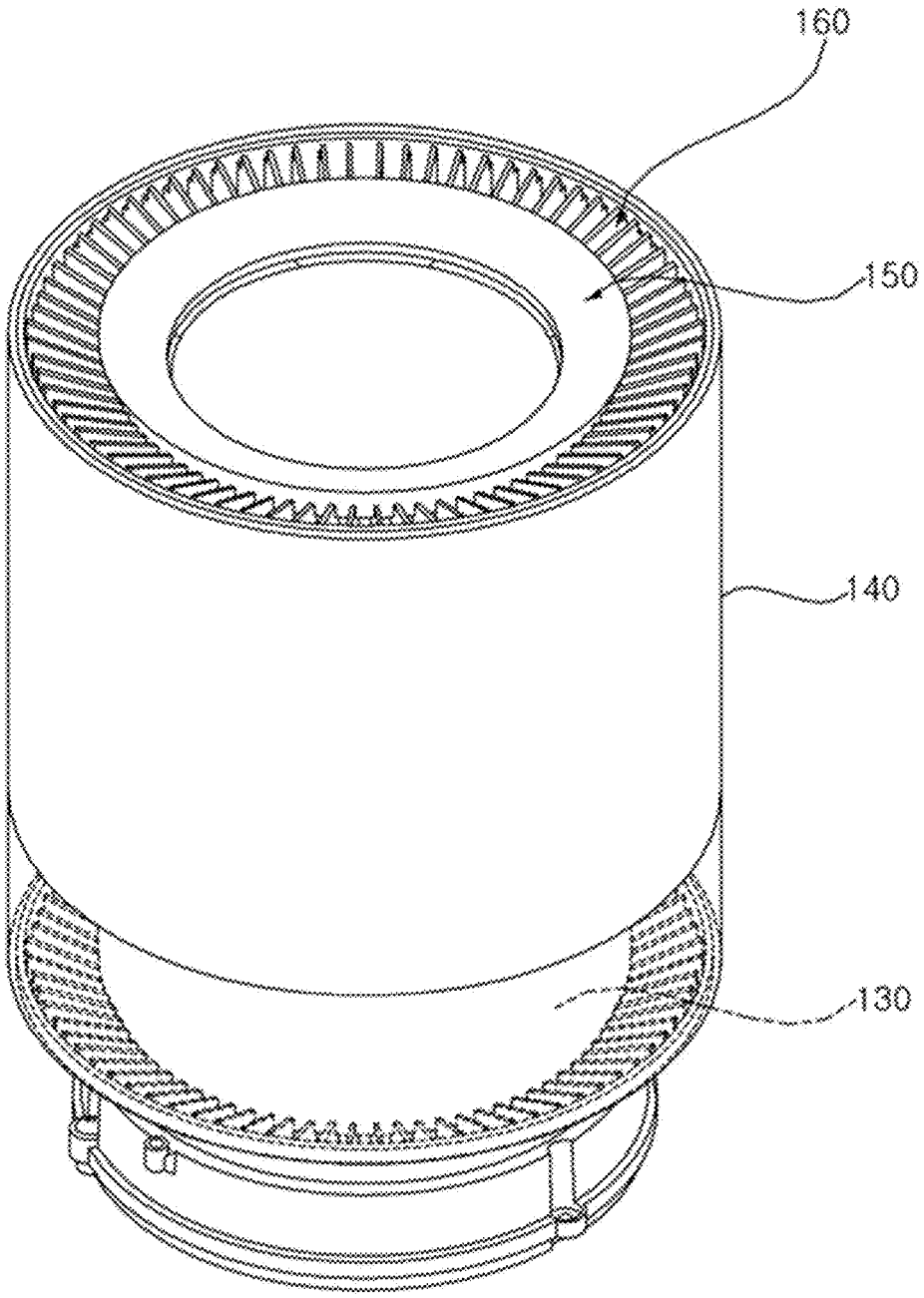
FIG. 7 is a perspective view of a flow path unit of a humidifier according to an embodiment.

Referring to FIG. 7, the flow path unit 100 in an embodiment of humidifier 1 may include a shell 130, 140, the discharge grill 160, and the water tank cover 150. The flow path unit 100 may include the shell 130, 140, also referred to herein as inner shell 130 and outer shell 140. The case 10 may include the shell 130, 140. The shell 130, 140 may form the outer shape of the flow path unit 100. The shell 130, 140 may have an accommodating space formed therein. The water tank 110 may be accommodated in the shell 130, 140. A discharge flow path 1000 may be formed inside the shell 130, 140. The upper side of the shell 130, 140 may be open. A discharge hole 1600 may be formed in the upper side of the shell 130, 140.

The discharge grill 160 may be disposed in the upper side of the shell 130, 140. The discharge grill 160 may be disposed in the discharge hole 1600. The discharge grill 160 may be disposed in the upper end of the shell 130, 140. For example, the discharge grille 160 may extend along the inner circumference of the upper end of the shell 130, 140. The discharge grille 160 may include a plurality of vanes.

The water tank cover 150 may be disposed in the upper side of the shell 130, 140. The water tank cover 150 may cover the open upper side of the water tank 110. The water tank cover 150 may open or close the water tank 110. The water tank cover 150 may be disposed inside the discharge grill 160. The water tank cover 150 may be disposed at the center of the annular discharge grill 160. For example, the water tank 110 may be disposed at the center of the shell 130, 140, and the water tank cover 150 may cover the open upper side of the water tank 110.

Figure 8:
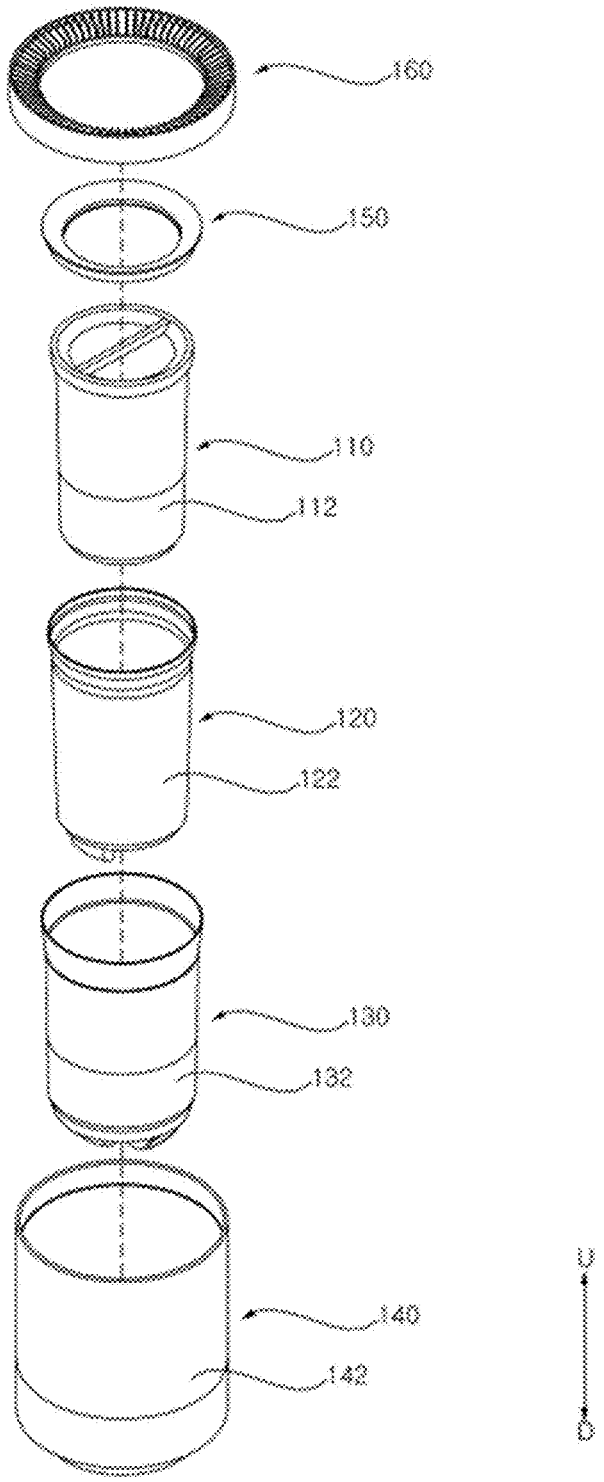
FIG. 8 is an exploded view of a coupling of flow path unit of a humidifier according to an embodiment.

Referring to FIG. 8, the flow path unit 100 in an embodiment of humidifier 1 may include the water tank 110, the water tank cover 150, the water tank housing 120, the inner shell 130, the outer shell 140, and the discharge grill 160. The water tank 110 may be formed in a cylindrical shape. The water tank 110 may extend in the up-down direction. A water storage space 1100 may be formed inside the water tank 110. The discharge grill 160 may extend along the circumference of the upper end of the water tank 110. The discharge grill 160 may be disposed in the outside of the upper end of the water tank 110. The water tank 110 may include a water tank peripheral wall 112 that forms the outer shape. The water tank peripheral wall 112 may partition the water storage space 1100 of the water tank 110.

The water tank housing 120 may accommodate the water tank 110. The water tank housing 120 may form an internal space in which the water tank 110 is disposed. The water tank housing 120 may surround the water tank 110. The water tank housing 120 may be a holder of the water tank 110. The water tank housing 120 may cover the water tank peripheral wall 112 of the water tank 110. The water tank 110 may be fitted to the water tank housing 120. The water tank peripheral wall 112 may be in close contact with the inner peripheral wall of the water tank housing 120. The water tank housing 120 may be fixed to prevent the inserted water tank 110 from moving in the horizontal direction. The water tank housing 120 may be maintained horizontally so that the water tank 110 does not fall inside the case 10. The water tank housing 120 and the water tank 110 may be separated from the case 10 respectively. The water tank housing 120 may include a housing peripheral wall 122 that partitions the internal space.

The shell 130, 140 may include the inner shell 130. The case 10 may include the inner shell 130. The inner shell 130 may accommodate the water tank 110 and/or the water tank housing 120. The inner shell 130 may be spaced radially outwards from the water tank 110 and/or the water tank housing 120. The first discharge flow path 1000*a* may be formed between the inner shell 130 and the water tank housing 120. The first discharge flow path 1000*a* may be formed between the water tank 110 and the inner shell 130. The second discharge flow path 1000*b* may be formed between the inner shell 130 and the case 10. Humidified air generated in the humidifying device 200 may flow through the first discharge flow path 1000*a*. The inner shell 130 may partition the first discharge flow path 1000*a* and the second discharge flow path 1000*b*. The inner shell 130 may include an inner peripheral wall 132 that partitions the internal space.

The shell 130, 140 may include the outer shell 140. The case 10 may include the outer shell 140. The outer shell 140 may form the outer shape of the flow path unit 100. The outer shell 140 may have an internal space. The outer shell 140 may have an open upper side. The outer shell 140 may accommodate the water tank 110, the water tank housing 120, and/or the inner shell 130. The outer shell 140 may be spaced radially outwards from the water tank 110, the water tank housing 120, and/or the inner shell 130. The discharge flow path 1000 may be formed inside the shell 140. The discharge flow path 1000 may be formed between the outer shell 140 and the water tank 110. For example, the first discharge flow path 1000*a* may be formed between the water tank housing 120 and the inner shell 130, and the second discharge flow path 1000*b* may be formed between the inner shell 130 and the outer shell 140. The outer shell 140 may include an outer peripheral wall 142 that divides the internal space.

Figure 9:
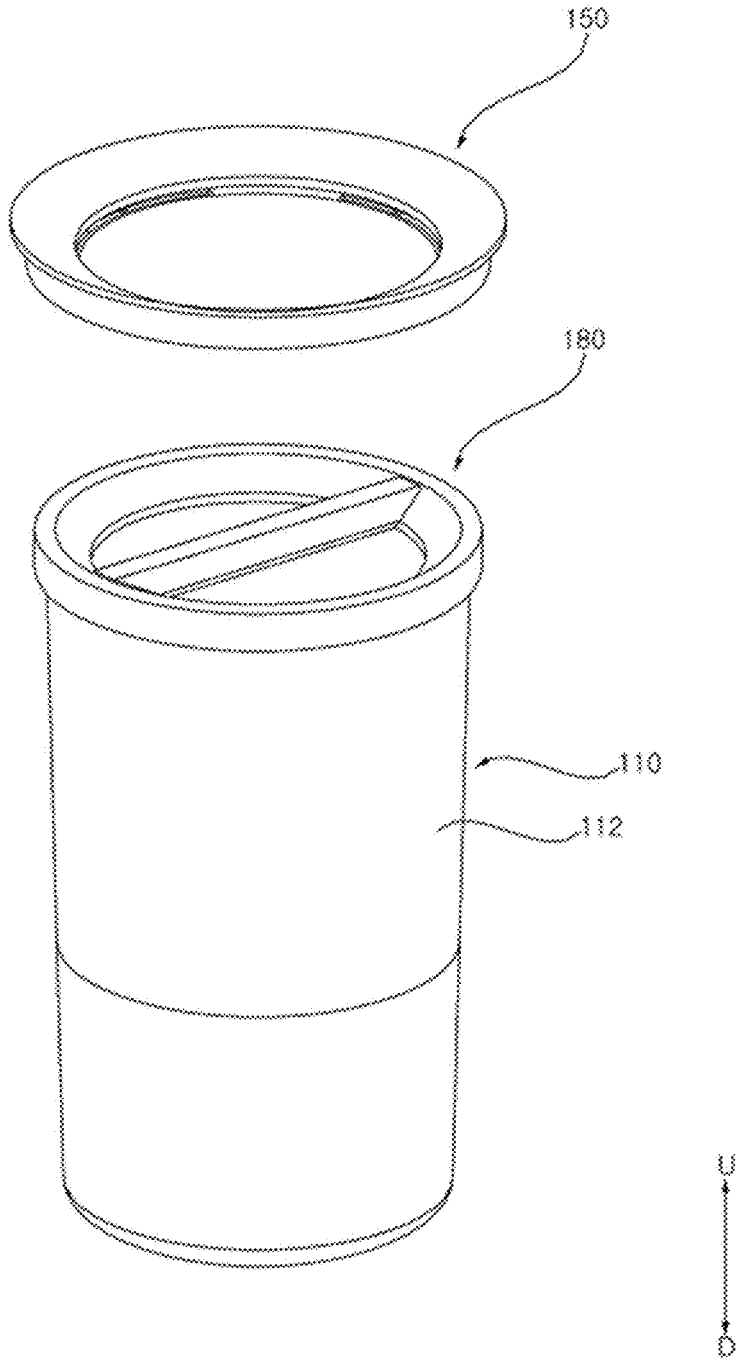
FIG. 9 is a perspective view of a water tank and a water tank cover of a humidifier according to an embodiment.
Figure 10:
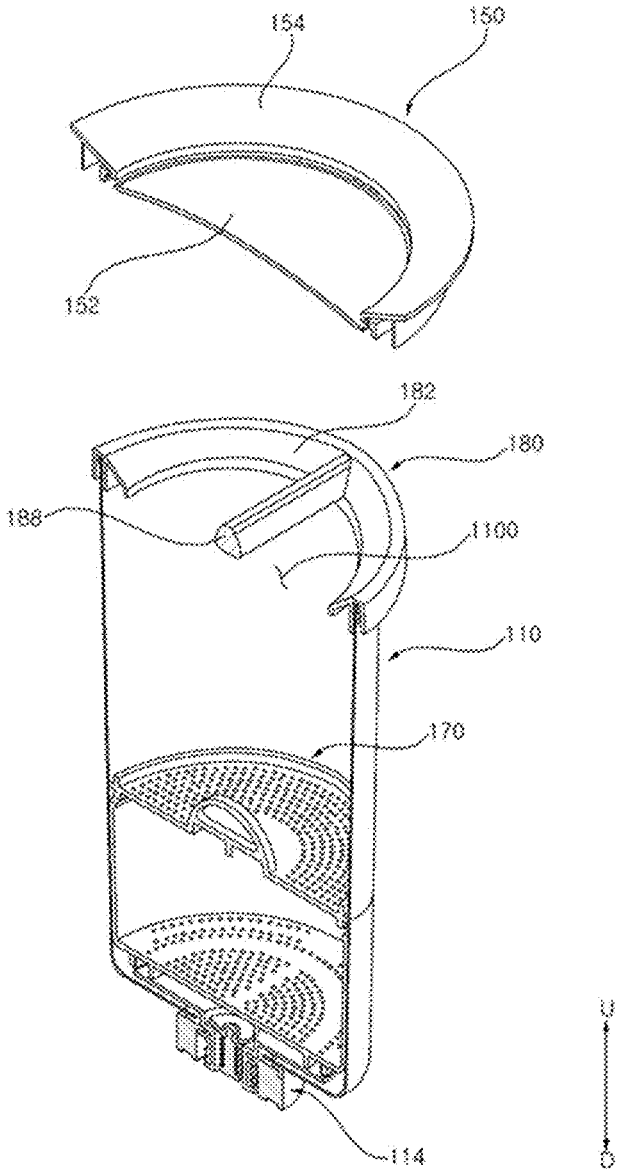
FIG. 10 is a cross-sectional perspective view of a water tank and a water tank cover of a humidifier depicted in FIG. 9.

Referring to FIGS. 9 and 10, the humidifier 1 in an embodiment may include a water tank handle 180, an ion exchange resin 170, and an injection device 114. The water tank handle 180 may be fixed to a portion of the water tank 110. In one example, the water tank handle 180 may be rotated and fastened to the water tank 110. The water tank handle 180 may be coupled to the upper end of the water tank 110. The water tank cover 150 may be disposed in the upper side of the water tank handle 180. The water tank cover 150 may cover the water tank handle 180. The water tank handle 180 may be disposed between the water tank cover 150 and the water tank 110.

The water tank handle 180 may include a handle rim 182 coupled to the upper end of the water tank 110. The handle rim 182 may be fixed to the upper end of the water tank 110. The handle rim 182 may extend along at least a portion of the circumference of the upper end of the water tank 110. The handle rim 182 may be formed in an annular or other shape.

The water tank handle 180 may include a handle bar 188. The handle bar 188 may be fixed to the handle rim 182. A user may move the water tank 110 by holding the handle bar 188. For example, a user may hold and pull the handle bar 188 upward to separate the water tank 110 from the case 10. In addition, a user may hold the handle bar 188 and apply a downward force to insert the water tank 110 into the case 10. The handle bar 188 may be formed in a substantially straight line as a bar shape. The handle bar 188 may be coupled to a portion of the handle rim 182. The handle bar 188 may extend to the handle rim 182 in the diametric direction.

The ion exchange resin 170 may be disposed inside the water tank 110. The ion exchange resin 170 may be disposed in the water storage space 1100. The ion exchange resin 170 may be in close contact with the inner side surface of the water tank 110. The ion exchange resin 170 may change the composition of the water stored in the water storage space 1100. The ion exchange resin 170 may exchange ion with the water stored in the water storage space 1100. The ion exchange resin 170 may selectively remove or replenish some ions contained in the water stored in the water storage space 1100. The ion exchange resin 170 may include a cation exchange resin and an anion exchange resin. The cation exchange resin may absorb cations contained in the water stored in the water storage space 1100. The cation exchange resin may emit cations to the water stored in the water storage space 1100. The anion exchange resin may absorb anions contained in the water stored in the water storage space 1100. The anion exchange resin may emit anions from the water stored in the water storage space 1100.

The injection device 114 may be disposed in one side of the water tank 110. The injection device 114 may be detachably coupled to the water tank 110. For example, the injection device 114 may be detachably coupled to the lower surface of the water tank 110. The injection device 114 may discharge the water stored in the water storage space 1100 out of the water tank 110. The injection device 114 may be mounted in the supply pipe 210 of the humidifying device 200. The injection device 114 may inject water stored in the water storage space 1100 into the supply pipe 210.

Referring to FIG. 10, the water tank cover 150 may include a guide rim 154 and a guide cover 152. The guide rim 154 may form the circumference of the water tank cover 150. For example, the guide rim 154 may form the rim of the water tank cover 150. The guide rim 154 may be formed in an annular shape having an open center.

The guide cover 152 may be disposed inside the guide rim 154. The guide cover 152 may be disposed at the center of the guide rim 154. For example, the guide cover 152 may be disposed in the open center of the guide rim 154. The guide cover 152 may be formed in a substantially circular or other shape. For example, the guide cover 152 may have a circular plate or other shape.

A water supply hole may be formed between the guide rim 154 and the guide cover 152. For example, a water supply hole may be formed between the inner circumference of the guide rim 154 and the outer circumference of the guide cover 152, and water may be received in the water tank 110 through the water supply hole.

Figure 11:
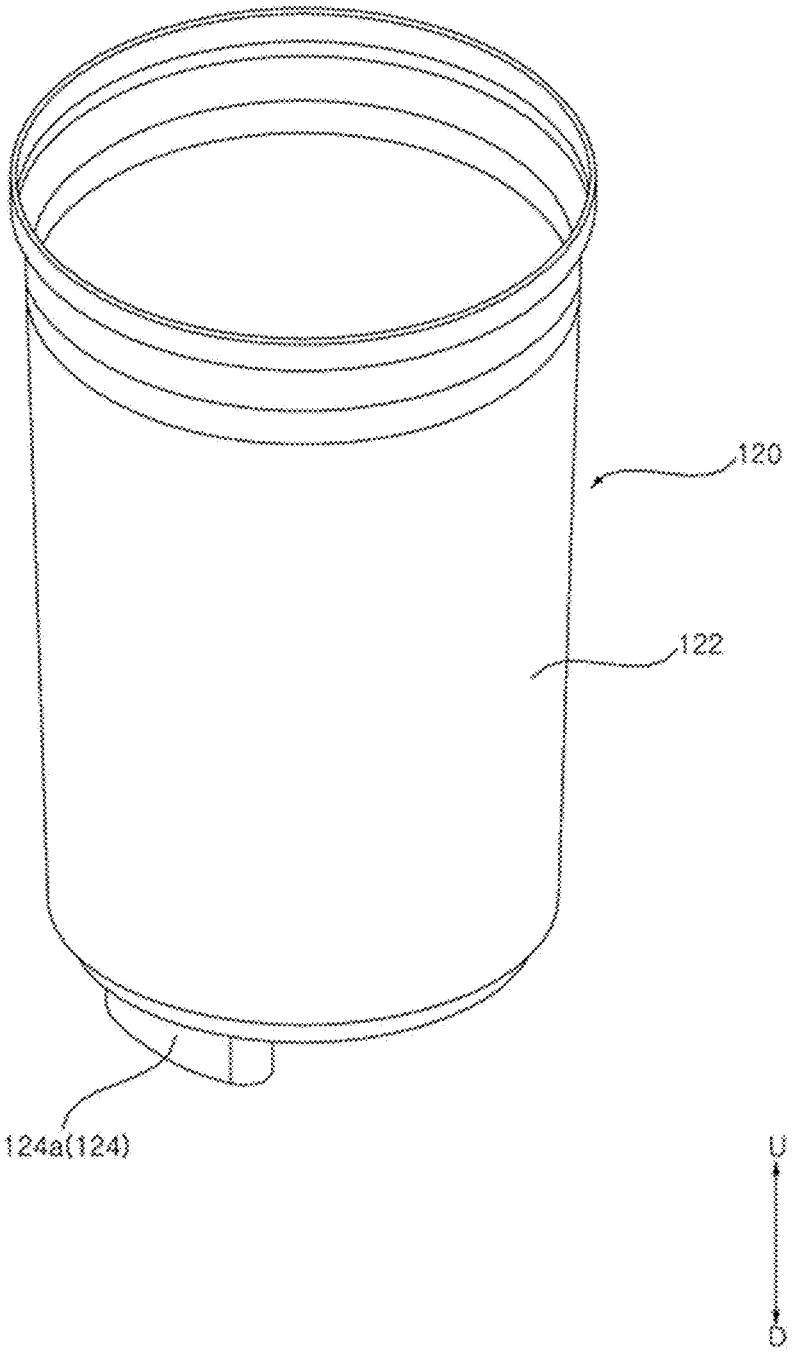
FIG. 11 is a perspective view of a water tank housing of a humidifier according to an embodiment.
Figure 12:
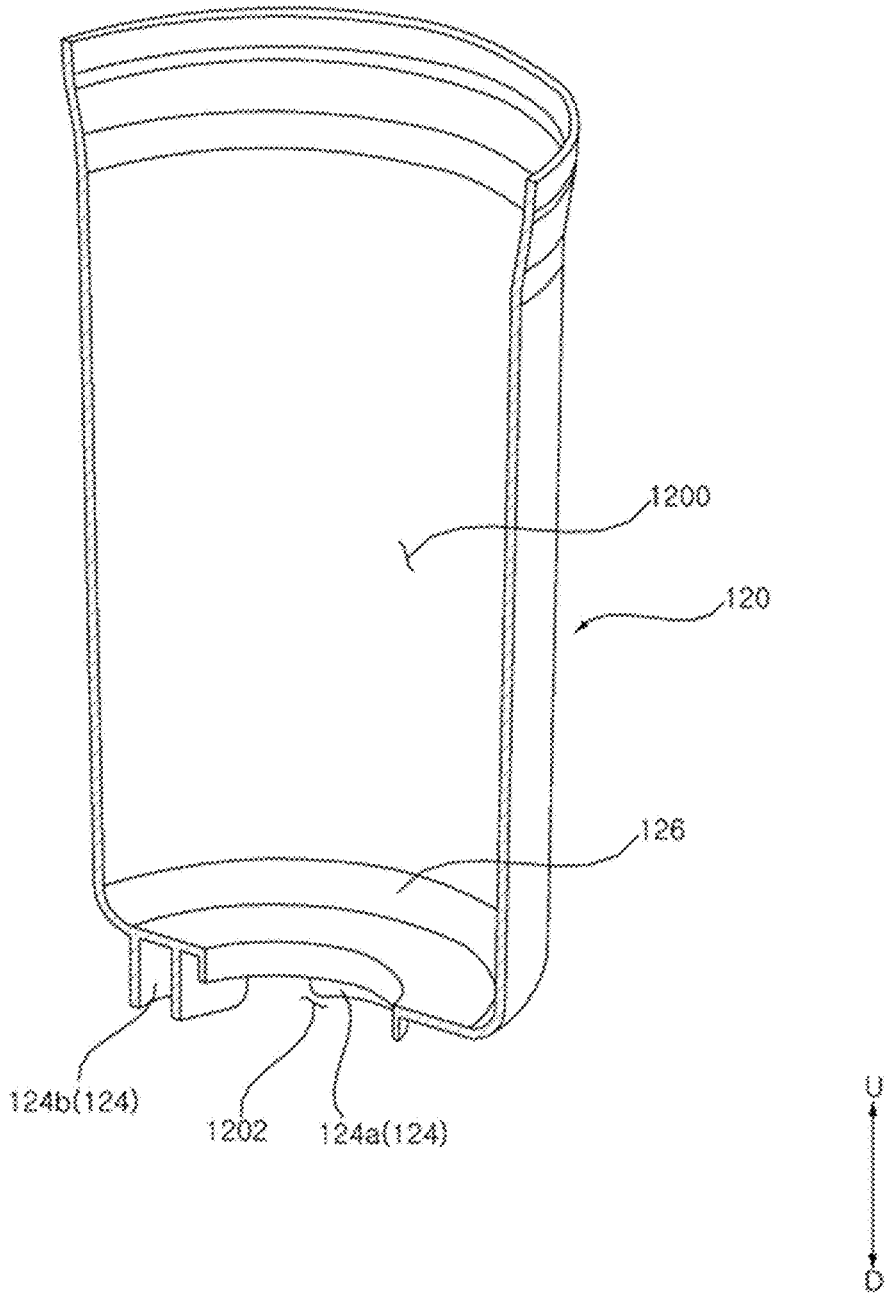
FIG. 12 is a cross-sectional perspective view of a water tank housing of a humidifier in FIG. 11.

Referring to FIGS. 11 and 12, the water tank housing 120 may include a housing support 124 and a housing injection hole 1202. The housing support 124 may extend downward from the water tank housing 120. The housing support 124 may be formed in the lower surface of the water tank housing 120. The housing support 124 may include a first housing support 124*a* and a second housing support 124*b*.

The first housing support 124*a* may protrude from the water tank housing 120. The first housing support 124*a* may extend from the lower surface of the water tank housing 120. For example, the first housing support 124*a* may extend in a downward direction from the lower surface of the water tank housing 120. The first housing support 124*a* may support the water tank housing 120. The first housing support 124*a* may transmit the load of the water tank housing 120 and/or the water tank 110 downward. There may be a plurality of the first housing supports 124*a*. The plurality of first housing supports 124*a* may be disposed in the lower surface of the water tank housing 120 to be spaced apart from each other. The plurality of first housing supports 124*a* may be disposed to be spaced apart from each other in the circumferential direction in the lower surface of the water tank housing 120. The plurality of first housing supports 124*a* may be radially disposed in the lower surface of the water tank housing 120. For example, a pair of first housing supports 124*a* may extend downward from the lower surface of the water tank housing 120, and the pair of first housing supports 124*a* may be spaced apart in opposite radial directions based on the center of the lower surface of the water tank housing 120.

The second housing support 124*b* may protrude from the water tank housing 120. The second housing support 124*b* may extend from the lower surface of the water tank housing 120. For example, the second housing support 124*b* may extend in a downward direction from the lower surface of the water tank housing 120. The second housing support 124*b* may support the water tank housing 120. The second housing support 124*b* may transmit the load of the water tank housing 120 and/or the water tank 110 downward. The second housing support 124*b* may prevent the water tank housing 120 from falling. The second housing support 124*b* may be located between two or more of the plurality of first housing supports 124*a*. For example, the pair of first housing supports 124*a* may be located spaced apart in a first radial direction and in a direction opposite to the first radial direction based on the center of the lower surface of the water tank housing 120, and the second housing support 124*b* may be located in a second radial direction perpendicular to the first radial direction.

The water tank housing 120 may include an insertion space 1200 in which the water tank 110 may be accommodated. The insertion space 1200 may be formed inside the water tank housing 120. The insertion space 1200 may be partitioned by the housing peripheral wall 122.

The injection device 114 may penetrate the lower surface of the water tank housing 120. The injection device 114 may protrude to the lower surface of the water tank housing 120. The injection device 114 may be mounted in the supply pipe 210 of the humidifying device 200.

The housing injection hole 1202 may be a through hole formed in the water tank housing 120. The injection device 114 may be disposed in the housing injection hole 1202. The injection device 114 may penetrate the housing injection hole 1202 and protrude to the lower side of the water tank housing 120. The injection device 114 protruding downward may be mounted in the supply pipe 210 of the humidifying device 200.

Figure 13:
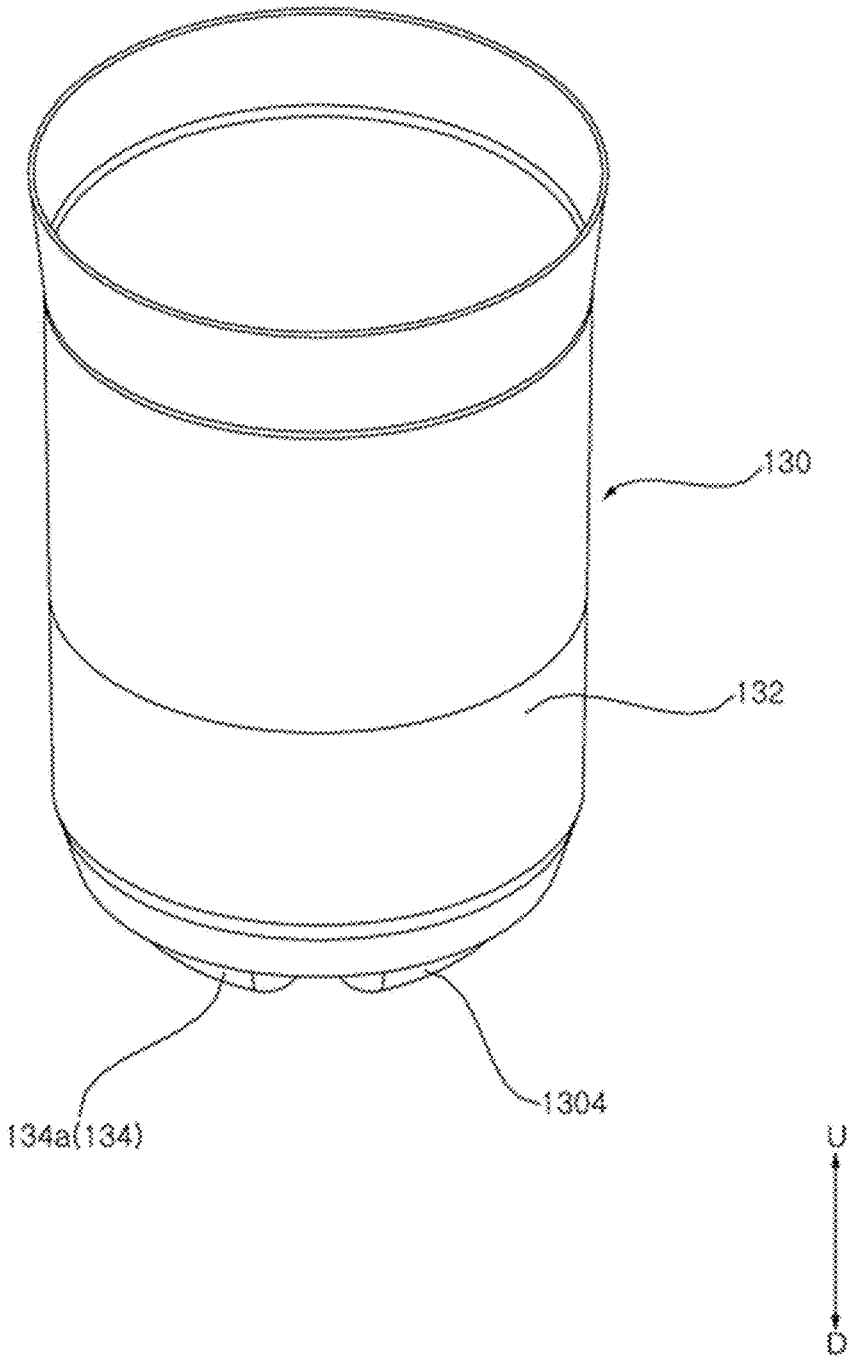
FIG. 13 is a perspective view of an inner shell of a humidifier according to an embodiment.
Figure 14:
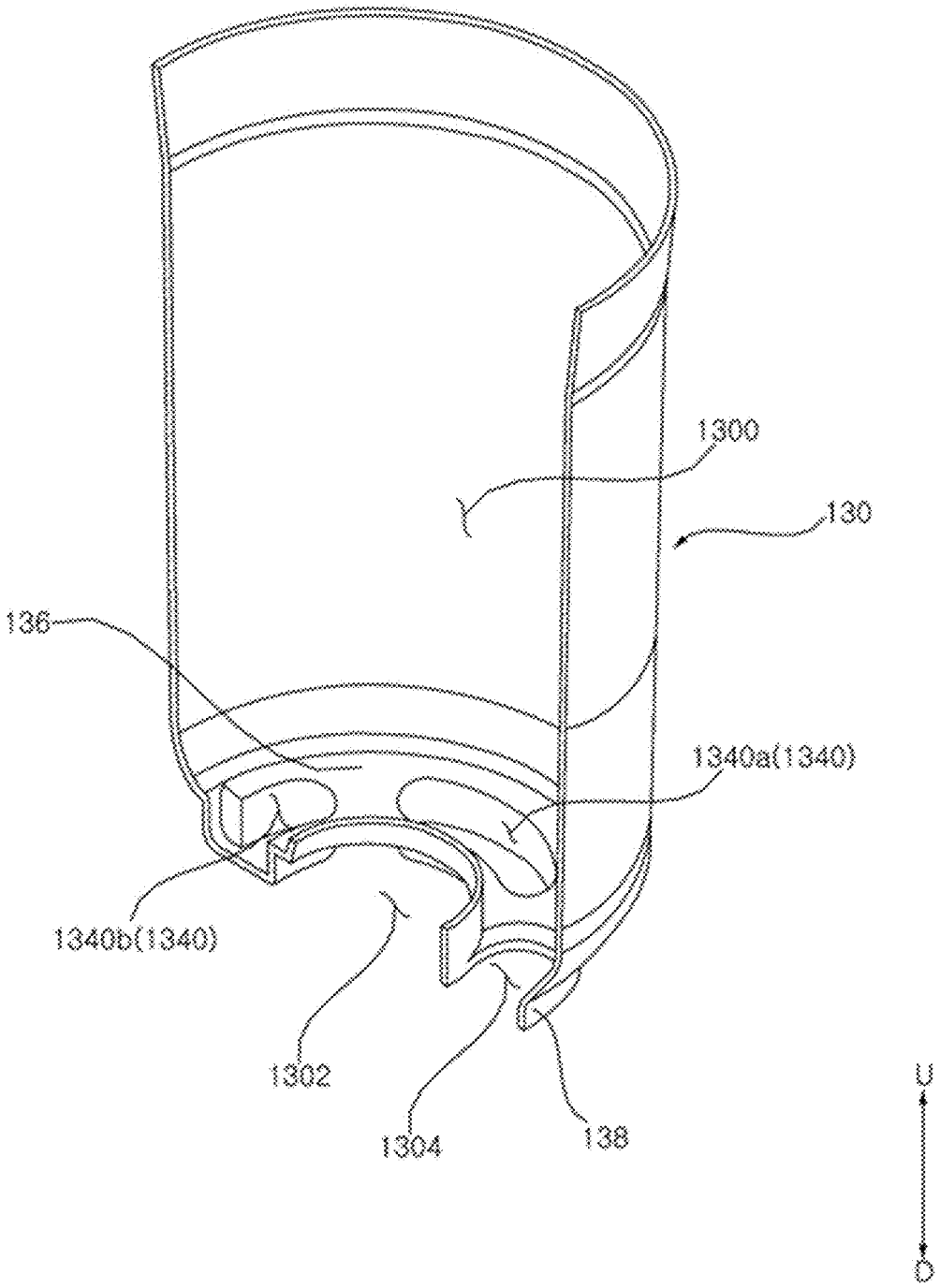
FIG. 14 is a cross-sectional perspective view of an inner shell of a humidifier in FIG. 13.

Referring to FIGS. 13 and 14, the inner shell 130 in an embodiment of humidifier 1 may include the insertion space 1300, a shell support 134, a shell inlet 1304, and a shell injection hole 1302. The inner shell 130 may include an insertion space 1300 in which the water tank 110 and/or the water tank housing 120 are accommodated. The water tank 110 and/or the water tank housing 120 may be inserted into the insertion space 1300 through the open upper side of the inner shell 130. The volume of the insertion space 1300 may be larger than the volume of the water tank 110 and/or the water tank housing 120. The insertion space 1300 may be partitioned by the inner peripheral wall 132.

The inner shell 130 may include a first shell support 134*a*. The first shell support 134*a* may protrude from the inner shell 130. The first shell support 134*a* may extend from the lower surface of the inner shell 130. For example, the first shell support 134*a* may extend downward from the lower surface of the inner shell 130. The first shell support 134*a* may support the inner shell 130. The first shell support 134*a* may transmit the load of the inner shell 130, the water tank housing 120, and/or the water tank 110 downward. There may be a plurality of first shell supports 134*a*. The plurality of first shell supports 134*a* may be disposed in the lower surface of the inner shell 130 to be spaced apart from each other. The plurality of first shell supports 134*a* may be disposed around the lower surface of the inner shell 130. A plurality of first shell supports 134*a* may be radially disposed in the lower surface of the inner shell 130. For example, a pair of first shell supports 134*a* extend downward from the lower surface of the inner shell 130, and the pair of first shell supports 134*a* may be spaced apart in opposite radial directions based on the center of the lower surface of the inner shell 130.

The inner shell 130 may include a support insertion portion 1340 in which the housing support 124 is disposed. The support insertion portion 1340 may include a first support insertion portion 1340*a*. The first housing support 124*a* may be disposed in the first support insertion portion 1340*a*. The first support insertion portion 1340*a* may be formed inside the first shell support 134*a*. That is, the first support insertion portion 1340*a* may be the inner space of the first shell support 134*a*. The first support insertion portion 1340*a* may be recessed from the bottom surface 136 of the inner shell 130. The first housing support 124*a* may be disposed inside the first shell support 134*a*. The first housing support 124*a* may transmit a load to the first shell support 134*a*. The location of the first shell support 134*a* may correspond to the location of the first housing support 124*a*. The number of first shell supports 134*a* may correspond to the number of first housing supports 124*a*.

The inner shell 130 may include a second shell support 134*b*. The second shell support 134*b* may protrude from the inner shell 130. The second shell support 134*b* may extend from the lower surface of the inner shell 130. For example, the second shell support 134*b* may extend downward from the lower surface of the inner shell 130. The second shell support 134*b* may support the inner shell 130. The second shell support 134*b* may transmit the load of the inner shell 130. The second shell support 134*b* may prevent the inner shell 130 from falling. The second shell support 134*b* may be located between the plurality of first shell supports 134*a*. For example, a pair of first shell supports 134*a* may be located spaced apart in a first radial direction and in a direction opposite to the first radial direction based on the center of the lower surface of the inner shell 130, and the second shell support 134*b* may be located in a second radial direction perpendicular to the first radial direction.

The support insertion portion 1340 may include a second support insertion portion 1340*b*. The second housing support 124*b* may be disposed in the second support insertion portion 1340*b*. The second support insertion portion 1340*b* may be formed inside the second shell support 134*b*. For example, the second support insertion portion 1340*b* may be an internal space of the second shell support 134*b*. The second support insertion portion 1340*b* may be recessed from the bottom surface 136 of the inner shell 130. At least a portion of the second housing support 124*b* may be disposed inside the second shell support 134*b*. The second housing support 124*b* may transmit a load to the second shell support 134*b*. The location of the second shell support 134*b* may correspond to the location of the second housing support 124*b*. The number of second shell supports 134*b* may correspond to the number of second housing supports 124*b*.

The inner shell 130 may include a shell inlet 1304 through which humidified air flows in. The shell inlet 1304 may be formed in the lower surface of the inner shell 130. The shell inlet 1304 may correspond to the humid air outlet 2742 of the humidifying device 200. For example, the humidified air generated in the humidifying device 200 may be discharged through the humid air outlet 2742, and the discharged humidified air may flow into the inner shell 130 through the shell inlet 1304. The inflow humidified air may flow through the first discharge flow path 1000*a* formed inside the inner shell 130.

The inner shell 130 may include a protruding rim 138 corresponding to the humid air outlet 2742. The protruding rim 138 may be at least a portion of a circumference forming the shell inlet 1304. The protruding rim 138 may extend downward from the circumference forming the shell inlet 1304. The protruding rim 138 may be in close contact with the discharge pipe 274 of the humidifying device 200. The cross-sectional shape of the protruding rim 138 may correspond to the cross-sectional shape of the discharge pipe 274 of the humidifying device 200. The lower end of the protruding rim 138 may be located on substantially the same plane as the lower end of the shell support 134. For example, the lower end of the protruding rim 138 may be located on substantially the same horizontal plane as the lower end of the first shell support 134*a* and the lower end of the second shell support 134*b*.

The inner shell 130 may include a shell injection hole 1302 into which the injection device 114 is inserted. The shell injection hole 1302 may be formed on the bottom surface 136 of the inner shell 130. The shell injection hole 1302 may be a through hole formed in the center of the bottom surface of the inner shell 130. The circumference forming the shell injection hole 1302 may extend upward. For example, a peripheral wall may extend upward from the circumference of the shell injection hole 1302 and may surround at least a portion of the injection device 114.

Figure 15:
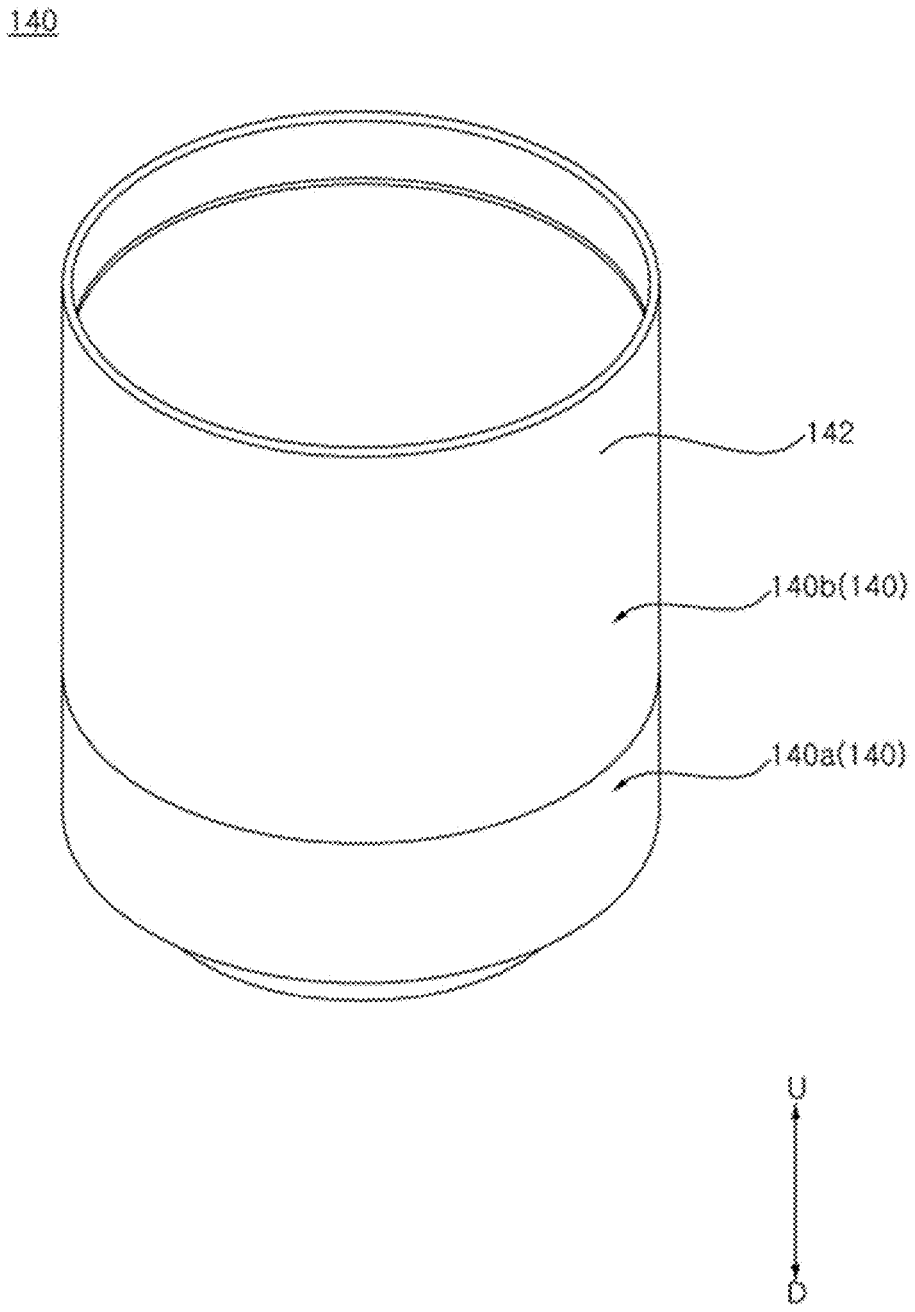
FIG. 15 is a perspective view of an outer shell of a humidifier according to an embodiment.
Figure 16:
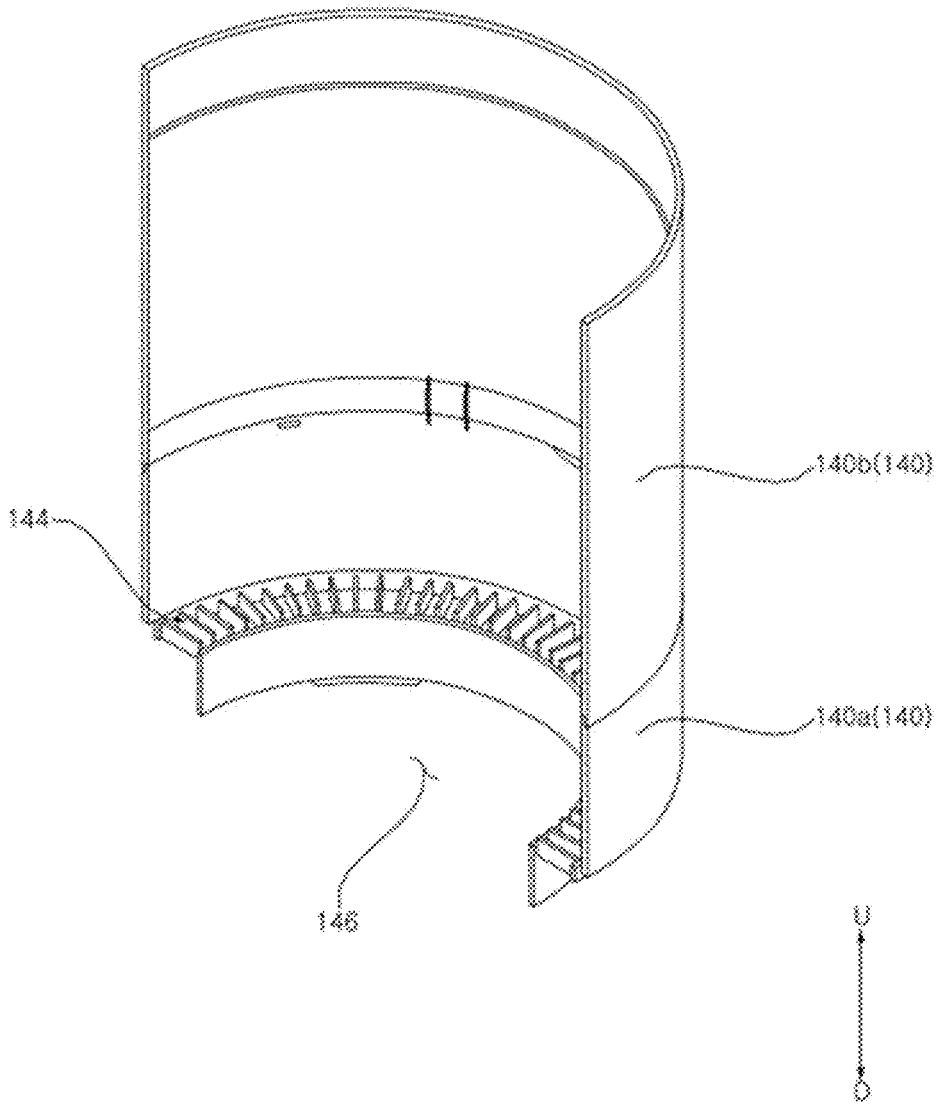
FIG. 16 is a cross-sectional perspective view of an outer shell of a humidifier in FIG. 15.

Referring to FIGS. 15 and 16, the outer shell 140 in an embodiment of humidifier 1 may include a first outer shell 140*a*, a second outer shell 140*b*, a shell opening 146, and a blowing grill 144. The outer shell 140 may include the first outer shell 140*a* and the second outer shell 140*b*, that may be coupled to the upper side of the first outer shell 140*a*. At least a portion of the first outer shell 140*a* may be formed to be transparent. The first outer shell 140*a* may be formed so that an inside thereof is visible through the first outer shell 140*a*. The first outer shell 140*a* may be formed of a light-transmissive material, such as a glass or a clear acrylic. The second outer shell 140*b* may be formed so that the inside is invisible. For example, the second outer shell 140*b* may be formed to be opaque. The second outer shell 140*b* may be formed of an opaque material such as a metal or opaque plastic. The second outer shell 140*b* may extend from the upper end of the first outer shell 140*a*. For example, the first outer shell 140*a* may form at least a portion of the lower portion of the outer shell 140, and the second outer shell 140*b* may form at least a portion of the remaining portion of the outer shell 140.

The blowing grill 144 may be disposed inside the outer shell 140. The blowing grill 144 may extend along at least a portion of the inner circumference of the outer shell 140. For example, the blowing grill 144 may be an annular and extend along the inner circumference of the first outer shell 140*a*. The blowing grill 144 may be disposed in the blowing flow path 390. The blowing grill 144 may be disposed between the blowing flow path 390 and the discharge flow path 1000. The blowing grill 144 may be disposed below the second discharge flow path 1000*b*. The blowing grill 144 may be disposed between the inner shell 130 and the outer shell 140. The rising airflow formed by the blowing fan 350 may pass through the blowing grill 144 and flow to the second discharge flow path 1000*b*.

The outer shell 140 may include a shell opening 146 that is open at the lower side. The shell opening 146 may be formed inside the blowing grill 144. The inner shell 130 may be disposed in the shell opening 146.

Figure 17:
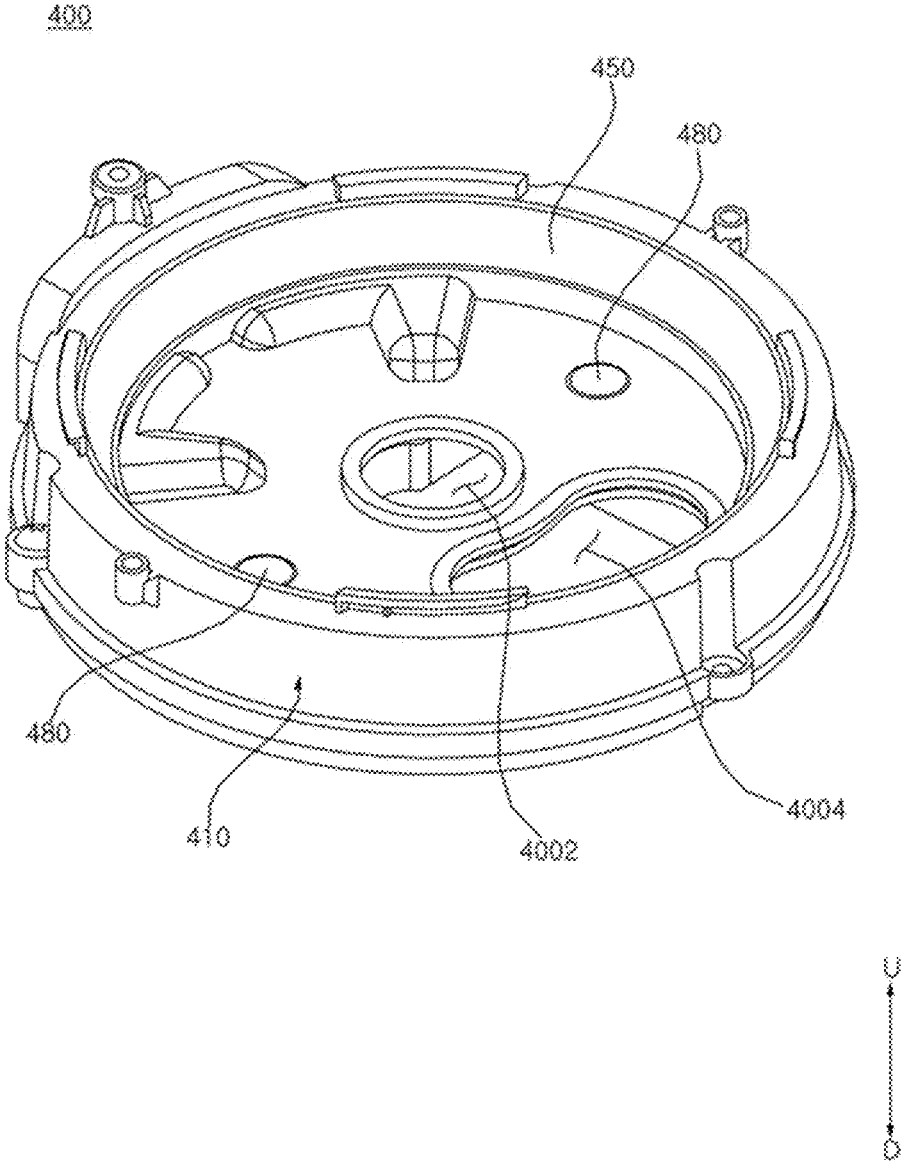
FIG. 17 is a perspective view of a middle tray of a humidifier according to an embodiment.

Referring to FIG. 17, the middle tray 400 in an embodiment of humidifier 1 may include a middle housing 410, a light diffuser 450, and a load sensor 480. The middle tray 400 may include the middle housing 410 that forms an external shape of the middle tray 400. The circumference of the middle housing 410 may extend in the up-down, vertical direction.

The middle tray 400 may include the light diffuser 450. The light diffuser 450 may emit light from a lighting device 460 (see FIG. 18). For example, the light diffuser 450 may diffuse light emitted from a light source 462 (see FIG. 19), to be described later. The light diffuser 450 may diffuse the light emitted from the light source 462 that may be a point light source and may provide a uniform surface light source. The light diffuser 450 may be referred to as a light-scatter. For example, the light diffuser 450 may be formed of light diffusion resin. The light diffusion resin may refer to a resin having light diffusion characteristics. For example, the light diffusion resin may include or be formed from polymethyl methacrylate (PMMA). Additionally or alternatively, the light diffusion resin may include or be formed from acrylonitrile butadiene styrene (ABS).

The light diffuser 450 may form the inner surface of the peripheral wall of the middle tray 400. The light diffuser 450 may be coupled to the middle housing 410. The light diffuser 450 may transmit light emitted from a light source disposed inside the middle tray.

The middle tray 400 may include a load sensor 480 that detects a load. The load sensor 480 may be disposed in the upper surface of the middle tray 400. The load sensor 480 may convert the load into an electrical signal. The load sensor 480 may convert a displacement in the up-down, vertical direction into an electrical signal. A plurality of load sensors 480 may be provided. For example, a pair of load sensors 480 may be disposed in the upper surface of the middle tray 400, and may detect load by converting displacement in the up-down, vertical direction into an electrical signal to be received by electrical equipment unit 380.

Figure 18:
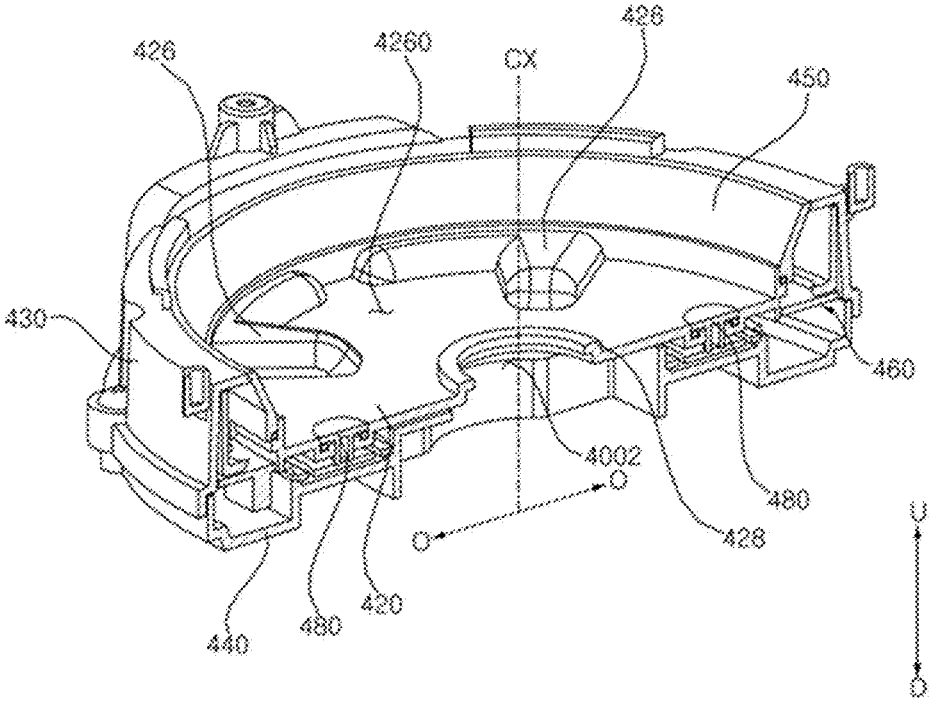
FIG. 18 is a cross-sectional perspective view of a middle tray of a humidifier in FIG. 17.

Referring to FIG. 18, the middle tray 400 in one embodiment of humidifier 1 may include a middle cover 430, a middle base 440, a middle plate 420, and a lighting device 460. The middle tray 400 may include the middle cover 430. The middle housing 410 may include the middle cover 430. The middle cover 430 may form at least a portion of an outer circumference of the middle housing 410. The middle cover 430 may be a peripheral wall extending in the up-down, vertical direction. The middle cover 430 may be coupled to the light diffuser 450.

The middle tray 400 may include the middle base 440. The middle housing 410 may include the middle base 440. The middle base 440 may form a lower plate of the middle tray 400. The middle base 440 may be seated on the upper surface of the humidifying device 200. The middle cover 430 may be coupled to the middle base 440. For example, the middle cover 430 may be coupled to the upper side of the middle base 440.

The middle tray 400 may include the middle plate 420. The middle housing 410 may include the middle plate 420. The middle plate 420 may form the upper surface of the middle tray 400. The inner shell 130 may be seated on the middle plate 420. The load of the water tank 110, the water tank housing 120, and/or the inner shell 130 may be transmitted to the middle plate 420. The load sensor 480 may be disposed in the middle plate 420.

The middle plate 420 may include a middle injection hole 4002 in which the supply pipe 210 may be disposed. The middle injection hole 4002 may be a through hole formed in the middle plate 420. The middle injection hole 4002 may be formed at the center of the middle plate 420.

The middle plate 420 may include an injection rib 428 that protrudes upward from the circumference of the middle injection hole 4002. The injection rib 428 may be a boundary forming the middle injection hole 4002. The middle injection hole 4002 may be located inside the injection rib 428. The injection rib 428 may protrude upward from the middle plate 420.

The middle plate 420 may include a middle discharge hole 4004 through which humidified air passes. The middle discharge hole 4004 may be formed in one side of the middle plate 420. The middle discharge hole 4004 may be a through hole formed in the middle plate 420. A shape of the middle discharge hole 4004 may correspond to a shape of the humid air outlet 2742. The shell inlet 1304 of the inner shell 130 may be connected to the middle discharge hole 4004. The protruding rim 138 of the inner shell 130 may correspond to the circumference forming the middle discharge hole 4004.

The light diffuser 450 may be coupled to the middle plate 420. The light diffuser 450 may be disposed between the middle cover 430 and the middle plate 420. The middle plate 420 may be disposed in the upper side of the middle base 440.

The middle plate 420 may include a support seating portion (or support seating surface) 4260. The second shell support 134*b* of the inner shell 130 may be seated in the support seating portion 4260. In one example, the first shell support 134*a* of the inner shell 130 may press the load sensor 480. The middle plate 420 may include a protruding end 426 forming the support seating portion 4260. The protruding end 426 may protrude upward from the middle plate 420. For example, the support seating portion 4260 may be formed between a pair of protruding ends 426 that protrude upward. The protruding end 426 may minimize the horizontal clearance of the second shell support 134*b*.

The middle tray 400 may include a lighting device 460 that emits light. The lighting device 460 may be disposed inside the middle housing 410. The lighting device 460 may be disposed between the middle cover 430 and the light diffuser 450. For example, the lighting device 460 may be located outside of the light diffuser 450 in a horizontal direction, and may be located inside of the middle cover 320 in a horizontal direction. The lighting device 460 may be disposed in lower than the light diffuser 450. The lighting device 460 may be disposed higher than the middle base 440. The light emitted from the lighting device 460 may penetrate the light diffuser 450. For example, light emitted from the lighting device 460 may pass through and be diffused by the light diffuser 450. The light emitted from the lighting device 460 may pass through the light diffuser 450 and be diffused into the inside of the case 10.

Figure 19:
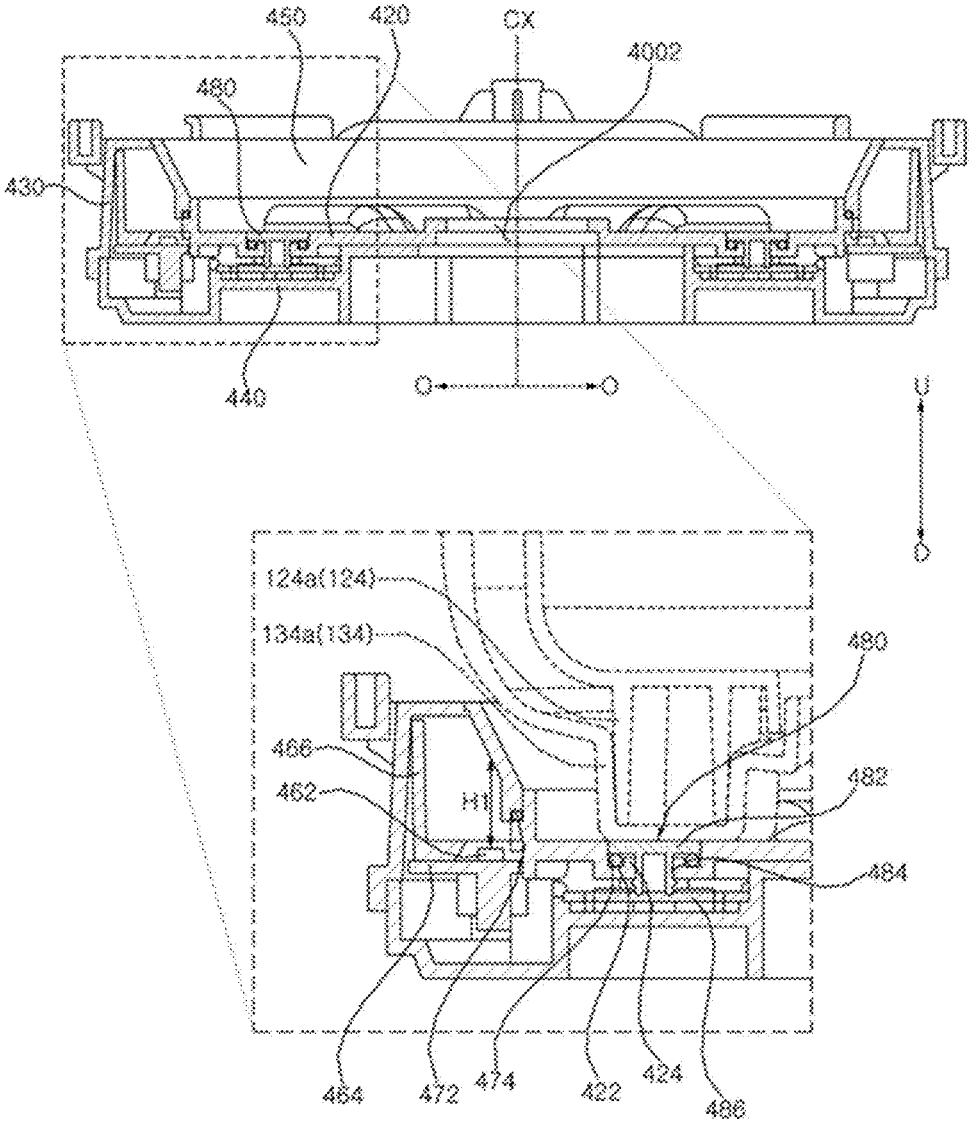
FIG. 19 is a cross-sectional view of a middle tray of a humidifier according to an embodiment.

Referring to FIG. 19, the lighting device 460 may include a light source 462, a lighting substrate 464, and a lighting bracket 466. The light source 462 may be mounted in the lighting substrate 464. The light source 462 may be disposed lower than the light diffuser 450. The light source 462 may be positioned horizontally between the upper end and lower end of the light diffuser 450. The light source 462 may be located inside the middle cover 430 in the horizontal direction. For example, the light source 462 may be located inside the inner end of the middle cover 430 in the horizontal direction. The light source 462 may be spaced upward from the middle base 440. The light source 462 may be spaced apart from the light diffuser 450. The light diffuser 450 may be spaced upward from the light source 462. For example, the light diffuser may be spaced upward from the light source by a certain height H1.

The lighting substrate 464 may be disposed between the middle cover 430 and the middle plate 420. The lighting substrate 464 may be spaced upward from the middle base 440.

The lighting bracket 466 may fix the lighting substrate 464. The lighting bracket 466 may be connected to the middle cover 430. The lighting bracket 466 may fix the lighting substrate 464 to the middle cover 430. Through the lighting bracket 466, the lighting substrate 464 may be spaced upward from the middle base 440.

Figure 20:
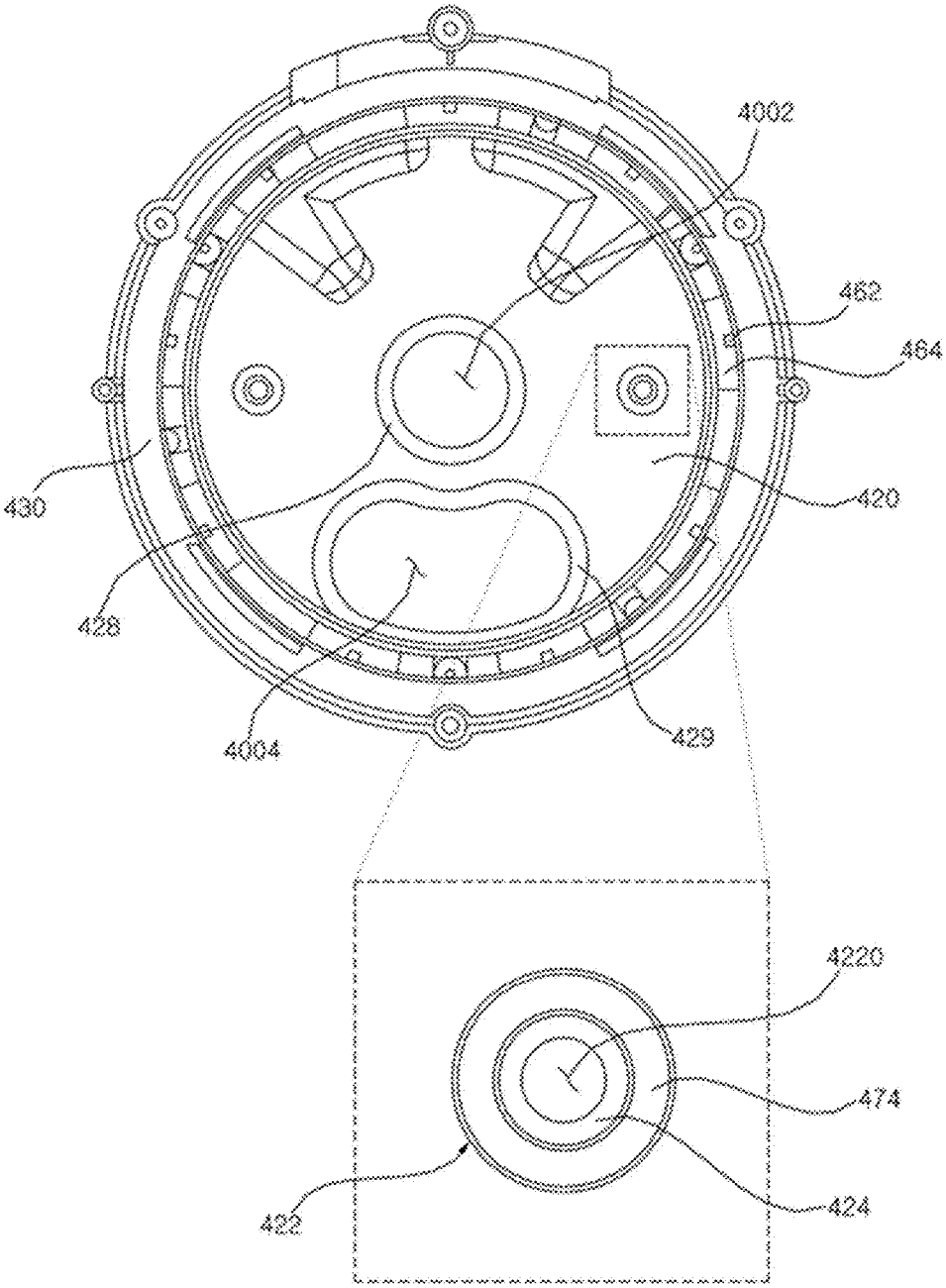
FIG. 20 is a plan view of a portion of a middle tray of a humidifier according to an embodiment.

Referring to FIGS. 19 and 20, the load sensor 480 an in implementation of humidifier 1 may include a contact plate 482, a presser (or presser extension) 484, and a sensor substrate 486. The first housing support 124*a* of the water tank housing 120 may pressurize the first shell support 134*a*. The first housing support 124*a* may be located inside the first shell support 134*a*. The first housing support 124*a* may transmit the load of the water tank 110 and the water tank housing 120 to the first shell support 134*a*. The first shell support 134*a* may pressurize the load sensor 480. The first shell support 134*a* may be in contact with the contact plate 482. The first shell support 134*a* may pressurize the contact plate 482, and thus the contact plate 482 may be lowered.

The presser 484 may extend downward from the contact plate 482. The presser 484 may transmit the load pressed on the contact plate 482 to the sensor substrate 486. The presser 484 may pass through the middle plate 420, and contact the sensor substrate 486 disposed inside the middle housing 410.

The middle tray 400 may include a recess 422 in which the load sensor 480 may be disposed. The recess 422 may be formed in the middle plate 420. The contact plate 482 may be disposed in the recess 422. The contact plate 482 disposed in the recess 422 may move in the up-down, vertical direction. The shape of the recess 422 may correspond to the shape of the contact plate 482. The recess 422 may have a through hole into which the presser 484 is inserted.

Components coupled to the sensor substrate 486 may measure the displacement of the contact plate 482. Components of the sensor substrate 486 may convert the displacement of the presser 484 into an electrical signal. The sensor substrate 486 may detect the load by measuring the electrical signal. The sensor substrate 486 may detect a mass and, thus, the level of water stored in the water tank 110 based on the load.

The middle plate 420 may include a sensor stopper 424 that restricts the movement range of the contact plate 482. The sensor stopper 424 may be located below the contact plate 482. The sensor stopper 424 may protrude upward from the recess 422. The sensor stopper 424 may extend along the circumference of the through hole formed in the recess 422. The sensor stopper 424 may be formed such that the circumference of the through hole formed in the recess 422 protrudes upward. The sensor stopper 424 may prevent the contact plate 482 from moving downward beyond a certain displacement. When the contact plate 482 moves downward to a certain displacement, the sensor stopper 424 may be in contact with a lower surface of the contact plate 482, and the contact plate 482 may no longer move downward.

Referring to FIGS. 19 and 20, the middle tray 400 in one embodiment of the humidifier may include a sealer (or seal) 470. The sealer 470 may include a first sealer (or first seal) 472 disposed between the light diffuser 450 and the middle housing 410. The first sealer 472 may be disposed lower than the light diffuser 450. The first sealer 472 may be disposed higher than the middle plate 420. The first sealer 472 may be disposed to the outer side of the circumference of the middle plate 420. The first sealer 472 may extend in the circumferential direction of the middle plate 420. The first sealer 472 may be formed in a substantially annular or other shape. The first sealer 472 may be in relatively close contact with (e.g., less than a threshold distance from) the light diffuser 450. The first sealer 472 may be in close contact with the middle plate 420. The cross-section of the first sealer 472 may be formed in a substantially circular or other shape.

The sealer 470 may include a second sealer (or second seal) 474 disposed lower than the load sensor 480. The second sealer 474 may be disposed between the load sensor 480 and the middle plate 420. The second sealer 474 may be disposed in the recess 422. The second sealer 474 may be disposed outside the sensor stopper 424. For example, the second sealer 474 may be disposed between the peripheral wall forming the recess 422 and the sensor stopper 424. The second sealer 474 may space the contact plate 482 upward from the sensor stopper 424. The second sealer 474 may buffer the load transmitted from the upper side. The second sealer 474 may be in relatively close contact with the contact plate 482. The second sealer 474 may be in relatively close contact with the recess 422. As the load transmitted to the contact plate 482 becomes larger, at least a portion of the second sealer 474 may further come in contact with the plate 482 and the recess 422. The second sealer 474 may extend along at least a portion of the circumference of the recess 422. The second sealer 474 may be formed in a substantially annular or other shape. The second sealer 474 may be formed in a circular cross-section. The diameter of the cross-section of the second sealer 474 may be smaller than the horizontal gap between the peripheral wall forming the recess 422 and the sensor stopper 424. Accordingly, when the second sealer 474 is compressed by a load, the second sealer 474 may be compressed in the vertical direction and stretched in the horizontal direction.

Referring to FIG. 20, the middle plate 420 according to an embodiment of humidifier 1 may include a discharge rib 429. The discharge rib 429 may protrude from the middle plate 420. The discharge rib 429 may form the middle discharge hole 4004. The discharge rib 429 may form a boundary forming the middle discharge hole 4004. The discharge rib 429 may extend upward from the circumference of the middle discharge hole 4004. The height at which the discharge rib 429 protrudes from the middle plate 420 may correspond to the height at which the injection rib 428 protrudes from the middle plate 420.

Figure 21:
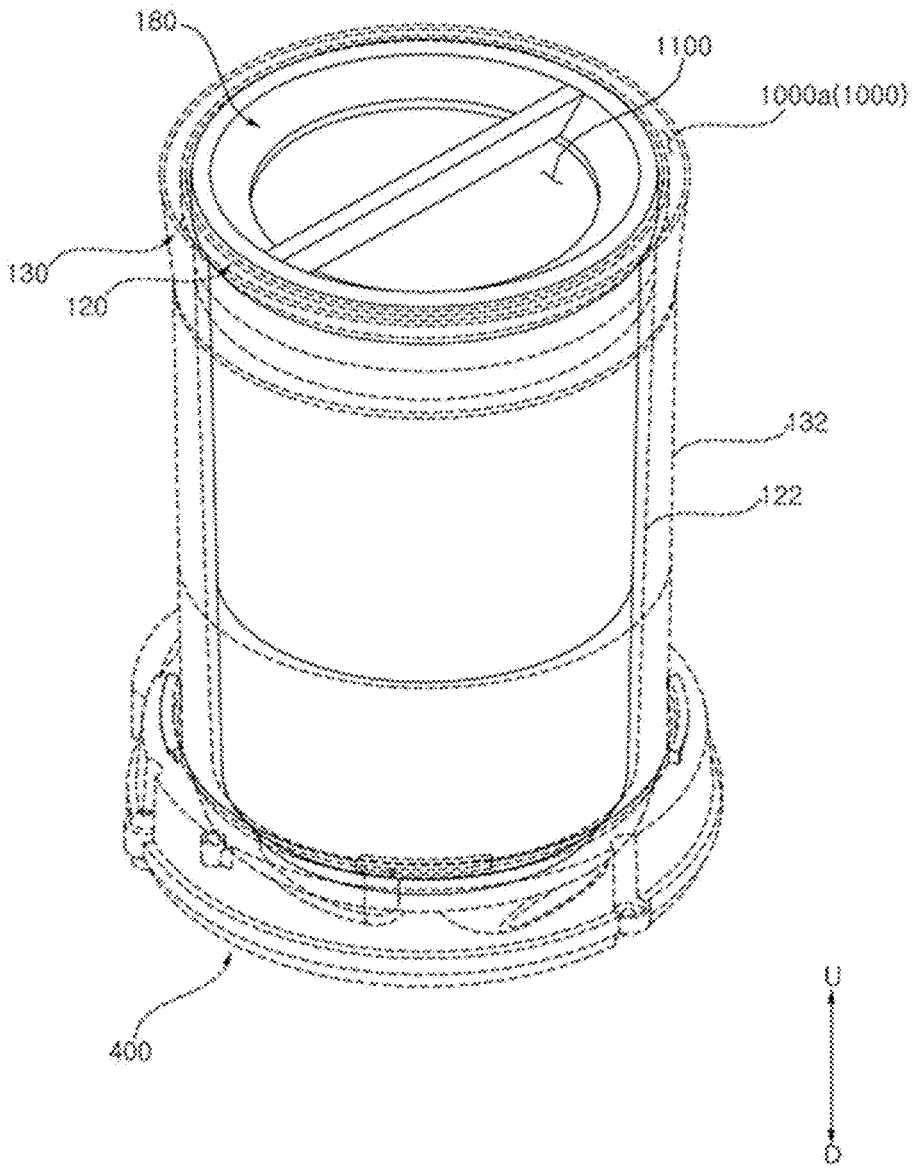
FIG. 21 is a perspective view of an inner shell and a middle tray of a humidifier according to an embodiment.
Figure 22:
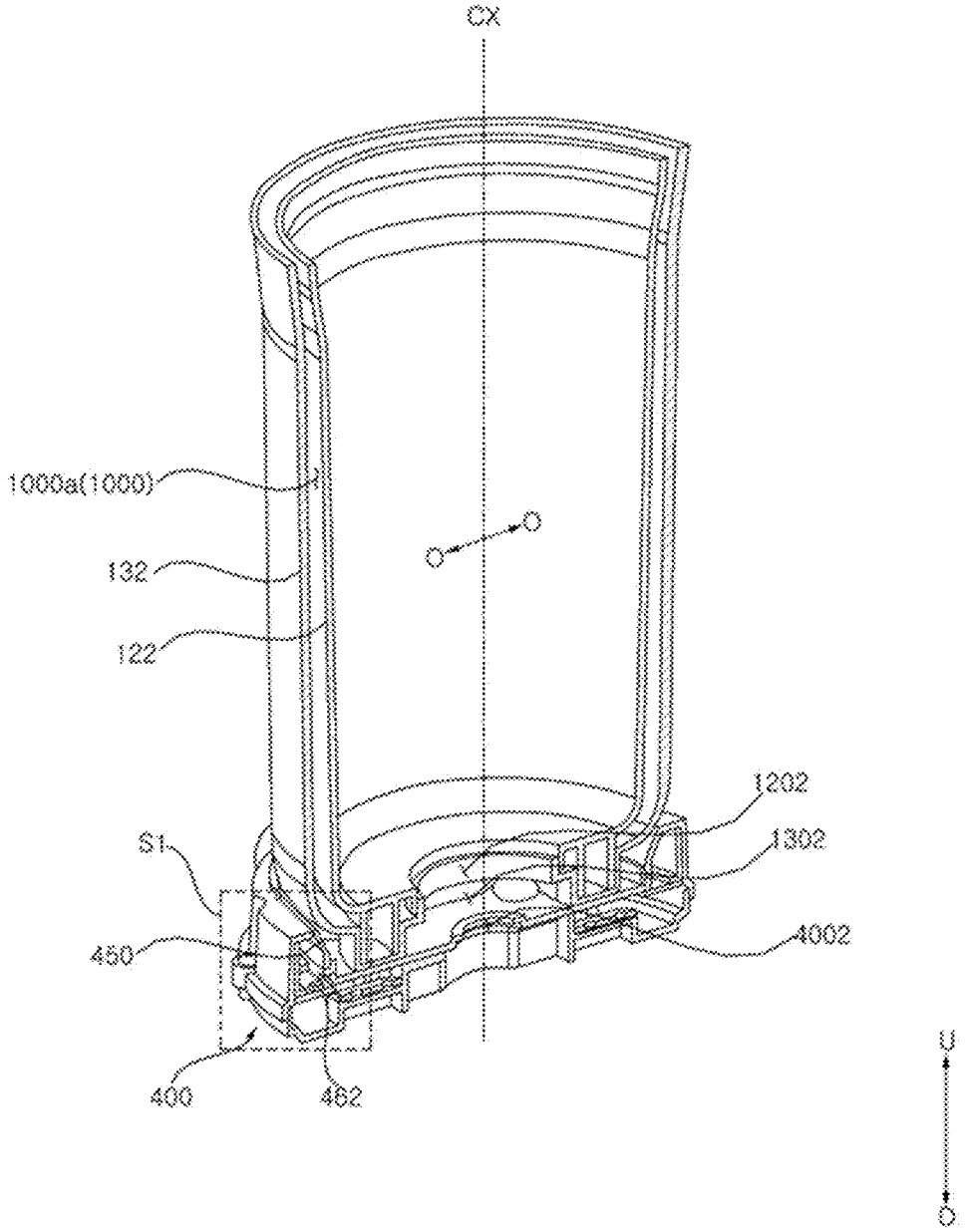
FIG. 22 is a cross-sectional perspective view of an inner shell and a middle tray of a humidifier according to an embodiment.

Referring to FIGS. 21 and 22, the inner shell 130 according to an embodiment of humidifier 1 may be disposed in the upper side of the middle tray 400. The inner shell 130 may be disposed in the upper side of the middle housing 410. The water tank 110, the water tank housing 120, and/or the inner shell 130 may be disposed in the upper side of the middle tray 400. The water tank 110 and/or the water tank housing 120 may be accommodated in the inner shell 130.

The inner shell 130 may be spaced outward from the water tank housing 120. A first discharge flow path **1000*a* may be formed between the inner shell 130 and the water tank housing 120. The water tank 110 may be accommodated in the water tank housing 120. The water tank 110 may be in relatively close contact with the inside of the water tank housing 120**.

The housing injection hole 1202 may be connected to the shell injection hole 1302. The shell injection hole 1302 may be connected to middle injection hole 4002. The housing injection hole 1202, the shell injection hole 1302, and the middle injection hole 4002 may form an injection space. The injection device 114 may be disposed in the injection space. The supply pipe 210 of the humidifying device 200 may protrude upward by penetrating the middle injection hole 4002. The injection device 114 may be mounted in the supply pipe 210.

The light diffuser 450 may face the inner shell 130. For example, the light diffuser 450 may face the lower portion of the inner shell 130. The light source 462 may be disposed in the lower side of the light diffuser 450. The light diffuser 450 may diffuse the light emitted from the light source 462. The light diffuser 450 may diffuse the light emitted from the light source 462 to illuminate the first discharge flow path **1000*a*. The inner shell 130 may be formed of a light-transmissive material. For example, at least a portion of the inner shell 130 may be formed to be transparent so that the first discharge flow path 1000*a* formed inside inner shell 130 may be visible from the outside. The light diffused by the light diffuser 450 may pass through the transparent inner shell 130 and spread to the first discharge flow path 1000*a*. The light may illuminate humidified air flowing through the first discharge flow path 1000*a*. A user may visually check the humidified air flowing through the first discharge flow path 1000*a* through the transparent inner shell 130**.

Figure 23:
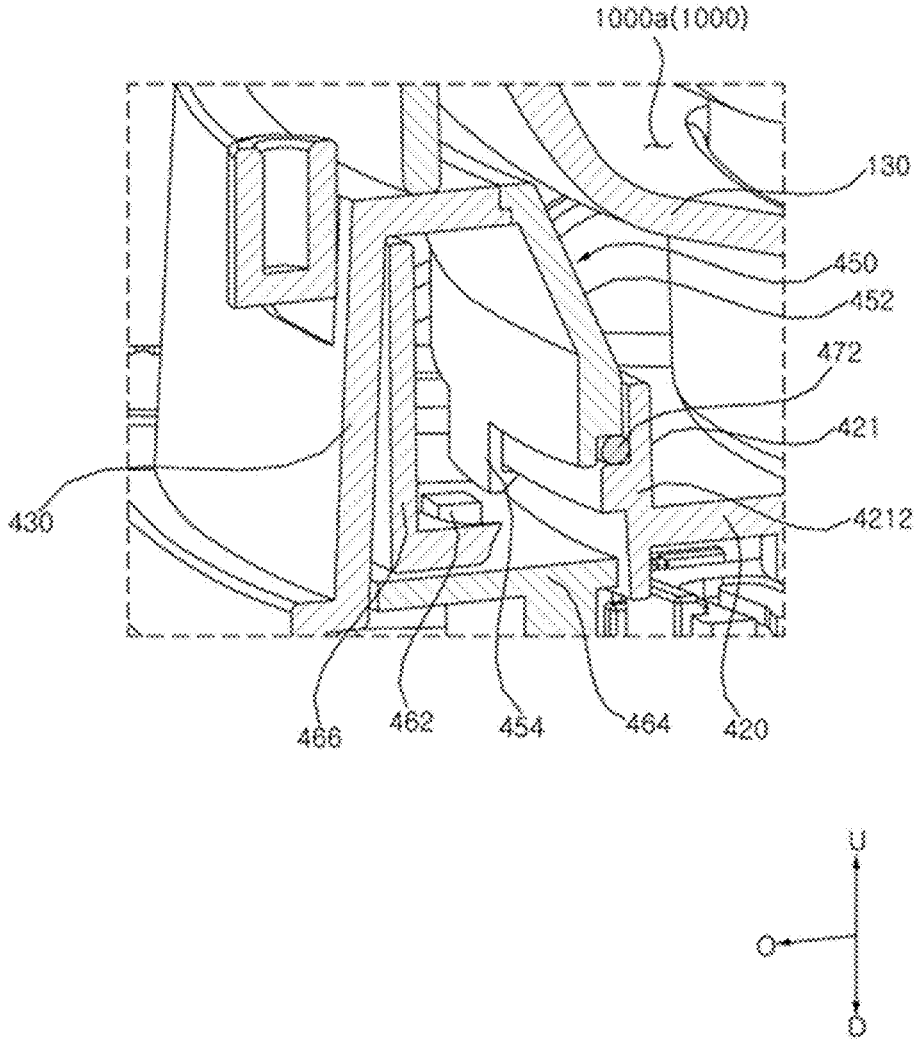
FIG. 23 is an enlarged view of region S1 in FIG. 22.

Referring to FIG. 23, the light diffuser 450 according to an embodiment of humidifier 1 may be connected to the middle cover 430. The light diffuser 450 and the middle cover 430 may be engaged with each other at a connection portion. The connection portion between the light diffuser 450 and the middle cover 430 may be in close contact. The light diffuser 450 and the middle cover 430 may be glued at the connection portion. The light diffuser 450 and the middle cover 430 may be formed as one body. For example, the light diffuser 450 and the middle cover 430 may be two-shot molded. Accordingly, a gap may not be formed between the light diffuser 450 and the middle cover 430.

The light diffuser 450 may be coupled to the middle plate 420. The light diffuser 450 may be seated on the middle plate 420. The middle plate 420 may include an inner peripheral wall 421 extending in the up-down direction from the circumference. The inner peripheral wall 421 may be a peripheral wall of the middle cover 430. The middle plate 420 may include a seating rib 4212 that protrudes outward from the inner peripheral wall 421. The light diffuser 450 may be seated on the seating rib 4212. For example, the light diffuser 450 may be disposed in the outside of the inner peripheral wall 421 and seated on the seating rib 4212.

The first sealer 472 may be disposed between the seating rib 4212 and the light diffuser 450. The first sealer 472 may be disposed in the upper side of the seating rib 4212. The first sealer 472 may be seated on the seating rib 4212. The light diffuser 450 may be disposed in the upper side of the first sealer 472. The light diffuser 450 may be seated on the first sealer 472 and pressurize the first sealer 472. The first sealer 472 may extend along the circumference of the middle plate 420. The first sealer 472 may seal the gap between the light diffuser 450 and the middle housing 410.

The light diffuser 450 may include a hook 454 coupled to the middle housing 410. The hook 454 may be coupled to the inside of the middle housing 410. The hook 454 may be coupled to the middle plate 420. The hook 454 may be coupled to the seating rib 4212. The hook 454 may extend from the light diffuser 450. The hook 454 may be fastened to the seating rib 4212, and the light diffuser 450 may be fixed to the middle plate 420.

The light diffuser 450 may include a diffuser slope (or sloped wall) 452 through which light emitted from the light source 462 is transmitted. The diffuser slope 452 may be disposed higher than the light source 462. The diffuser slope 452 may be inclined toward the center axis of the humidifier. For example, the diffuser slope 452 may be inclined downward in the radially inward center direction. Alternatively, the diffuser slope 452 may be inclined upward in the radial direction.

The diffuser slope 452 may face the center of the case 10. The diffuser slope 452 may face the inner shell 130. The diffuser slope 452 may face the discharge flow path 1000. For example, the diffuser slope 452 may face the first discharge flow path 1000*a*. The light emitted from the light source 462 may pass through the diffuser slope 452 and diffuse to the first discharge flow path 1000*a*.

Figure 24:
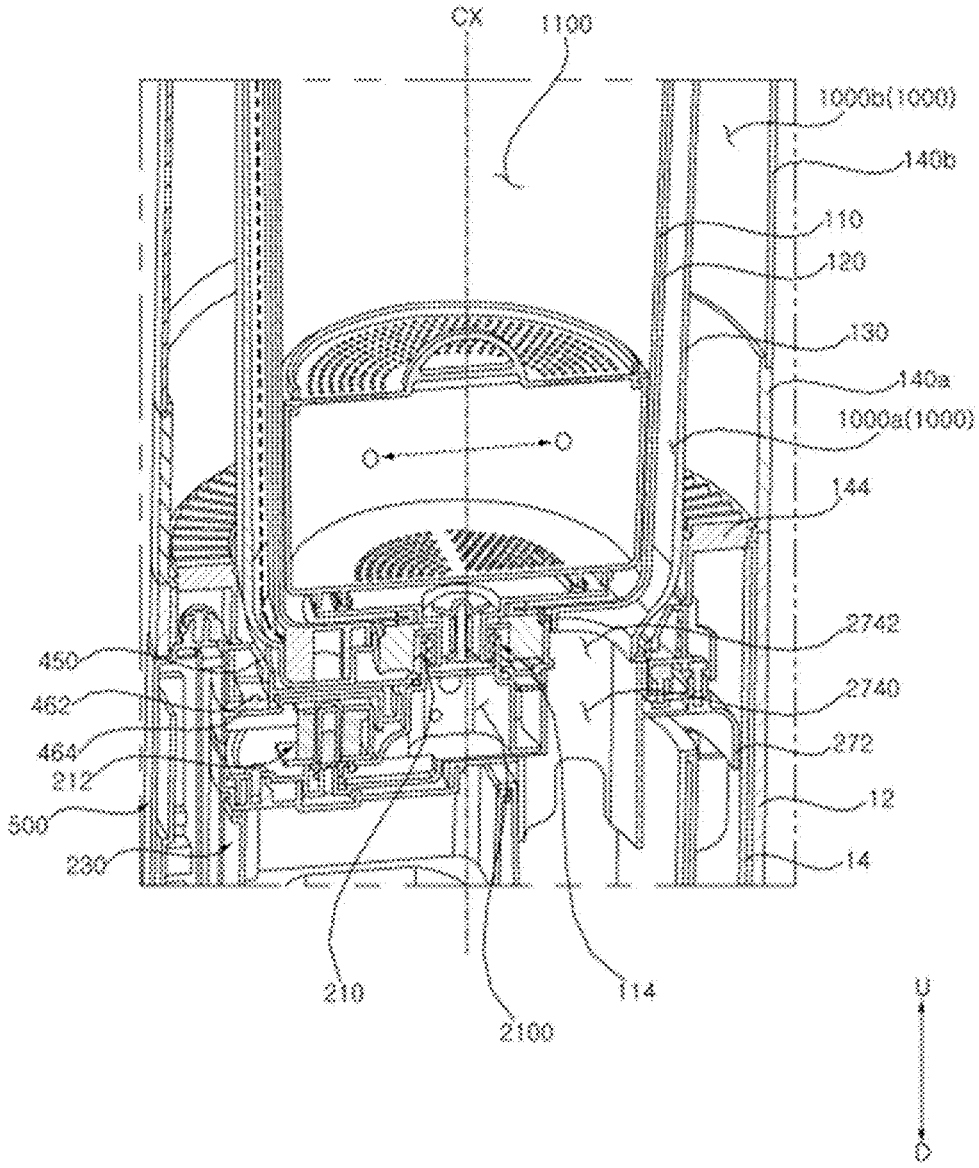
FIG. 24 is a cross-sectional perspective view of a humidifier according to an embodiment.
Figure 25:
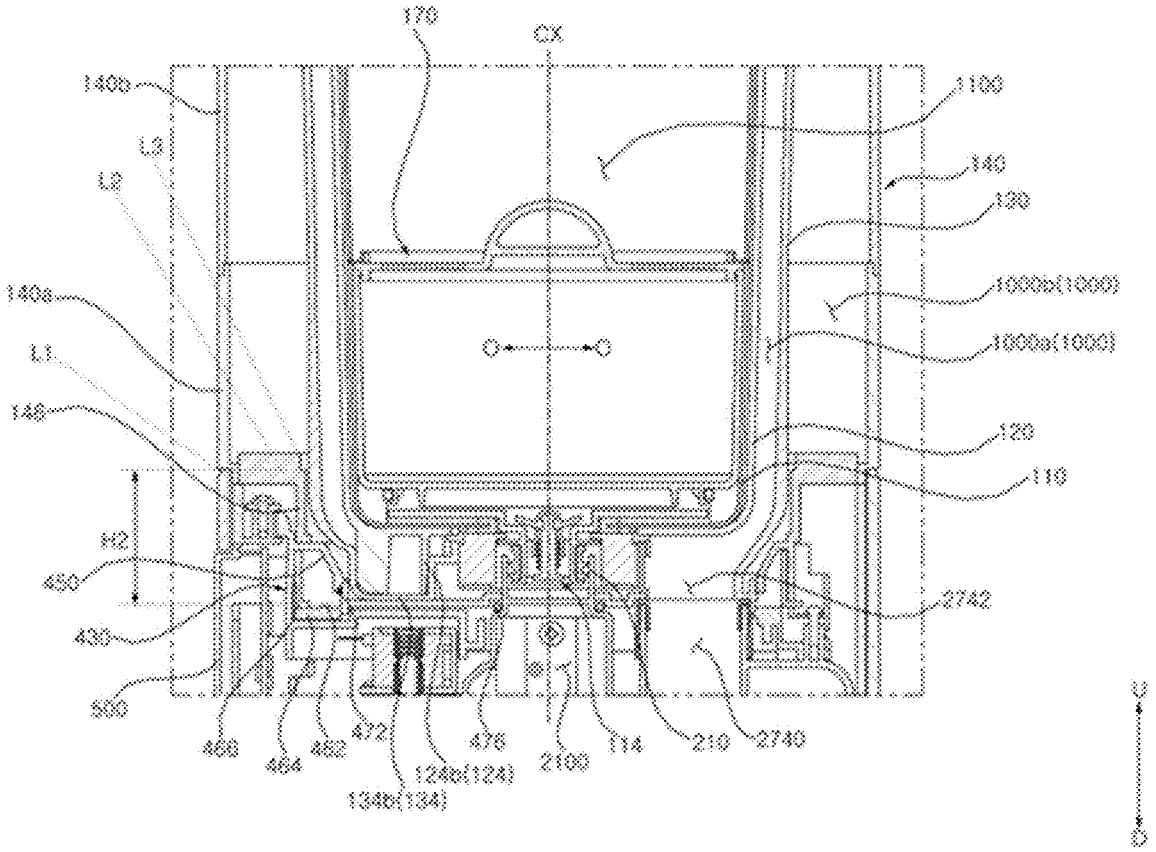
FIG. 25 is a cross-sectional view of a humidifier according to an embodiment.

Referring to FIGS. 24 and 25, the lighting device 460 according to one embodiment of humidifier 1 may emit light toward the first discharge flow path 1000*a*. The light source 462 may be disposed lower than the discharge flow path 1000 and may emit light upward. The light diffuser 450 may diffuse the light emitted from the light source 462. The light diffuser 450 may transmit light, which is emitted from a point light source, to appear as a substantially planar light source. The light diffuser 450 may be disposed in the outside of the inner shell 130. The light diffuser 450 may emit light to the inside of the inner shell 130. The emitted light may be transmitted to the first discharge flow path 1000*a* formed inside the inner shell 130. Through this light transmission, the light emitted from the light source 462 may illuminate the humidified air flowing through the discharge flow path 1000.

At least a portion of the water tank housing 120 may be formed of a light-transmissive material. The water tank housing 120 may be formed so that the inside is visible to the outside. For example, the water tank housing 120 may be formed to from a transparent material such glass or acrylic. Accordingly, light emitted from the light source 462 may penetrate the water tank housing 120.

At least a portion of the water tank 110 may be formed of a light reflective material. For example, the water tank 110 may be formed so that the inside of water tank 110 is not visible. In one example, the water tank 110 may be formed of a metal material. For example, the water tank 110 may be formed of stainless steel. The light emitted from the light source 462 may not transmit through the water tank 110. The light emitted from the light source 462 may be reflected by the water tank 110 and directed to the first discharge flow path 1000*a*. The light emitted from the light source 462 may be transmitted upward while being reflected. In addition, the light may proceed along the discharge flow path 1000. The light illuminates the humidified air flowing through the discharge passage 1000, and a user may check the humidified air that flows inside through the first outer shell 140*a*, which is transparently formed in the outside of the humidifier 1.

The humidifier 1 may include a barrier wall 146 disposed inside the case 10. The barrier wall 146 may extend in the up-down, vertical direction. The barrier wall 146 may be disposed between the outer shell 140 and the inner shell 130. The barrier wall 146 may not transmit light. For example, the barrier wall 146 may be formed of an opaque material, such as a metal or opaque plastic. The barrier wall 146 may be located horizontally outward from the light source 462. The barrier wall 146 may be spaced horizontally outward from the light source 462. For example, the distance spaced from the central axis of the case 10 to the barrier wall 146 may be greater than the distance spaced from the central axis of the case 10 to the light source 462.

The barrier wall 146 may extend in the circumferential direction of the discharge flow path 1000. For example, the barrier wall 146 may be a substantially annular peripheral wall extending in the circumferential direction of the annular discharge flow path 1000. The barrier wall 146 may be disposed outside the discharge flow path 1000 through which humidified air flows. For example, the barrier wall 146 may be disposed outside the first discharge flow path 1000*a* through which humidified air flows. In this example, the barrier wall 146 may be disposed in the second discharge flow path 1000*b*. The barrier wall 146 may be spaced inward in the horizontal direction from the outer shell 140.

The barrier wall 146 may be connected to the blowing grill 144. The barrier wall 146 may extend downward from the inner end of the blowing grill 144. For example, the blowing grill 144 may be disposed along the inner circumference of the outer shell 140, and the barrier wall 146 may be a peripheral wall extending downward from the inner end of the blowing grill 144. At this time, the barrier wall 146 may have a shell opening. The inner shell 130 may be disposed in the shell opening.

The barrier wall 146 may be disposed in the upper side of the middle tray 400. The barrier wall 146 may be disposed in the upper side of the middle cover 430. At this time, the barrier wall 146 may be spaced outward from the inner shell 130. The barrier wall 146 may be located above the light diffuser 450 in the up-down direction. The vertical location of the upper end of the barrier wall 146 may correspond to or be located below the vertical location of the lower end of the first outer shell 140*a*. The vertical location of the upper end of the barrier wall 146 may be located above the vertical location of the upper end of the light diffuser 450.

The upper end of the barrier wall 146 may be spaced upward from the light source 462. For example, the upper end of the barrier wall 146 may be spaced upward from the light source 462 by a certain distance H2. The vertical separation distance H2 between the upper end of the barrier wall 146 and the light source 462 may affect the luminance of light emitted from the light diffuser 450. For example, as the vertical separation distance H2 between the upper end of the barrier wall 146 and the light source 462 increases, the luminance of light emitted from the light diffuser 450 may decrease. Conversely, as the vertical separation distance H2 between the upper end of the barrier wall 146 and the light source 462 decreases, the luminance of light emitted from the light diffuser 450 may increase.

The vertical location of the first outer shell 140*a* may be higher than the vertical location of the light source 462. For example, the vertical location of the lower end of the first outer shell 140*a* may be located higher than the vertical location of the light source 462. The vertical location of the first outer shell 140*a* may be located higher than the vertical location of the light diffuser 450. For example, the vertical location of the lower end of the first outer shell 140*a* may be located higher than the vertical location of the upper end of the light diffuser 450. Through this, the light emitted from the light diffuser 450 may not directly spread to the indoor space.

A first straight line L1 may be a virtual straight line connecting the lower end of the first outer shell 140*a* and the upper end of the light diffuser 450. The lower end of the first outer shell 140*a* and the upper end of the light diffuser 450 may be located on the same plane. For example, the lower end of the first outer shell 140*a* and the upper end of the light diffuser 450 may be located on a virtual plane where the central axis of the humidifier 1 is located. For example, the virtual first straight line L1 may be disposed on the same vertical plane as the central axis of the humidifier 1.

The second straight line L2 may be a virtual straight line connecting the upper and lower ends of the light diffuser 450. The upper and lower ends of the light diffuser 450 may be located on the same plane. For example, the upper and lower ends of the light diffuser 450 may be located on a virtual plane where the central axis of the humidifier 1 is located. For example, the virtual second straight line L2 may be disposed on the same vertical plane as the central axis of the humidifier 1.

The slope of the first straight line L1 may be smaller than the slope of the second straight line L2. For example, the slope of the second straight line L2 may be steeper than the slope of the first straight line L1. Through this difference in the slopes of L1 and L2, the light emitted through the light diffuser 450 may not be directly transmitted to a user through the transparent first outer shell 140*a*.

The third straight line L3 may be a virtual straight line connecting the upper end of the first outer shell 140*a* and the upper end of the barrier wall 146. The upper end of the first outer shell 140*a* and the upper end of the barrier wall 146 may be located on substantially the same plane. For example, the upper end of the first outer shell 140*a* and the upper end of the barrier wall 146 may be located on a virtual plane where the central axis of the humidifier 1 is located. For example, a virtual third straight line L3 may be disposed on substantially the same plane as the central axis of the humidifier 1. The third straight line L3 may be located in the upper side of the light diffuser 450. For example, the third straight line L3 may be spaced upward from the light diffuser 450. The third straight line L3 may represent the maximum viewing angle at which a user can look into the inside of the humidifier 1 through the transparent first outer shell 140*a*. The viewing angle may be based on the inner horizontal direction. For example, the viewing angle may increase in the order of L1, L2, and L3. Through this change in the viewing angle, the light emitted through the light diffuser 450 may not be directly transmitted to a user through the transparent first outer shell 140*a*.

Figure 26:
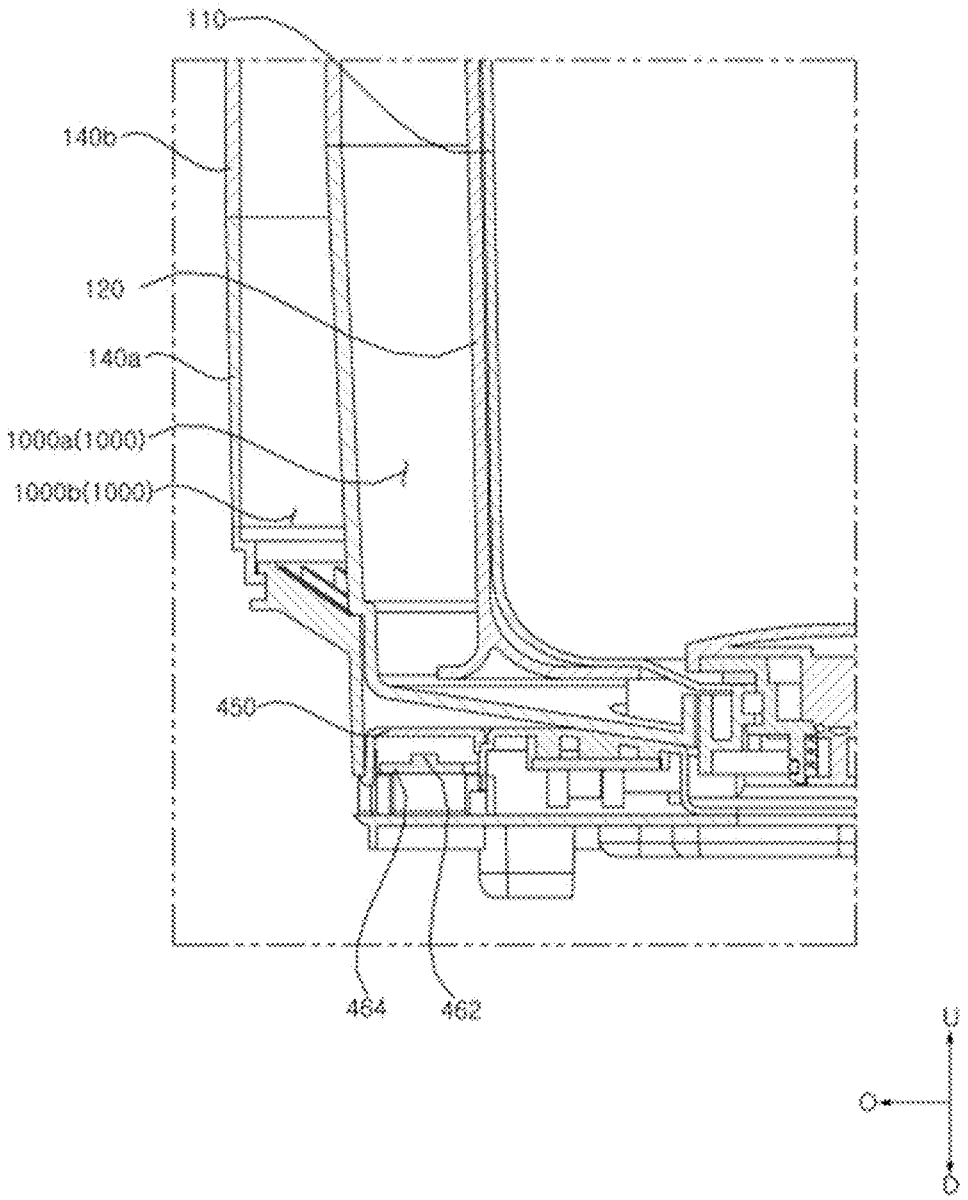
FIG. 26 is a cross-sectional view of a humidifier according to another embodiment.

Referring to FIG. 26, the light diffuser 450 according to one embodiment of humidifier 1 may cover the light source 462. For example, the light diffuser 450 may cover the upper and side surfaces of the light source. In this case, the light diffuser 450 may not be connected to the middle housing 410. The light diffuser 450 may be located lower than the inner shell 130. The light source 462 and/or the light diffuser 450 may be located inside, in a horizontal direction, of the inner peripheral wall 132. As used herein, inside in a horizontal direction may refer to a direction toward the center axis. The light diffuser 450 may be disposed in lower than the first discharge flow path 1000*a*. The light diffuser 450 may include a peripheral wall that covers the side surface of the light source 462, and an upper surface that covers the upper side of the light source 462. The upper surface of the light diffuser 450 may be formed to be flat. The flat upper surface of the light diffuser 450 may face the lower surface of the inner shell 130. The flat upper surface of the light diffuser 450 may face the first discharge flow path 1000*a*. The light diffuser 450 may diffuse the light emitted from the light source 462, and illuminate the humidified air flowing through the first discharge flow path 1000*a*.

Figure 27:
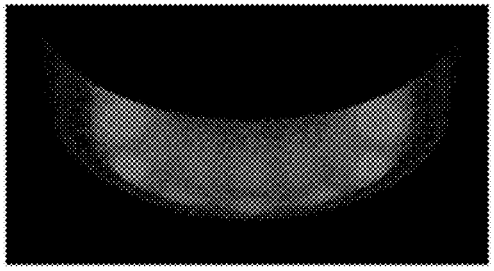
FIG. 27 is an image depicting a result of an optical experiment of a humidifier according to an embodiment.
Figure 27:
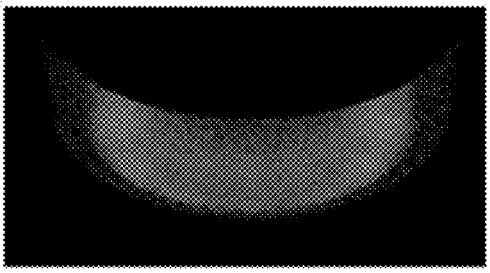

Referring to FIG. 27, the shape of light emitted to the outside may vary depending on the separation distance H1 between the light source 462 and the light diffuser 450.

Region (a) of FIG. 27 is an experimental result showing a light emission to the light diffuser 450 visible through the first outer shell 140*a*, when the separation distance between the light source 462 and the light diffuser 450 is 4 mm. Region (B) of FIG. 27 is an experimental result showing the light emission of the light diffuser 450 visible through the first outer shell 140*a*, when the separation distance between the light source 462 and the light diffuser 450 is 13 mm. If the separation distance H1 between the light source 462 and the light diffuser 450 is shortened, light condensation phenomenon may occur. The light condensation phenomenon may refer to a phenomenon that the light emitted from the light source 462, which is a point light source, is not spread uniformly by the light diffuser 450, and the surface portion of the light diffuser 450 corresponding to the location of the light source 462 emits light having a higher density than the surrounding portion. The vertical separation distance H1 between the light source 462 and the light diffuser 450 may affect the light diffusion performance by the light diffuser 450. In light of the experimental results, it can be seen that the light condensation phenomenon may be alleviated as the separation distance H1 between the light source 462 and the light diffuser 450 increases from 4 mm to 13 mm. Accordingly, the form of light emitted from the surface of the light diffuser 450 may change from a point emission form to a surface emission form.

Figure 28:
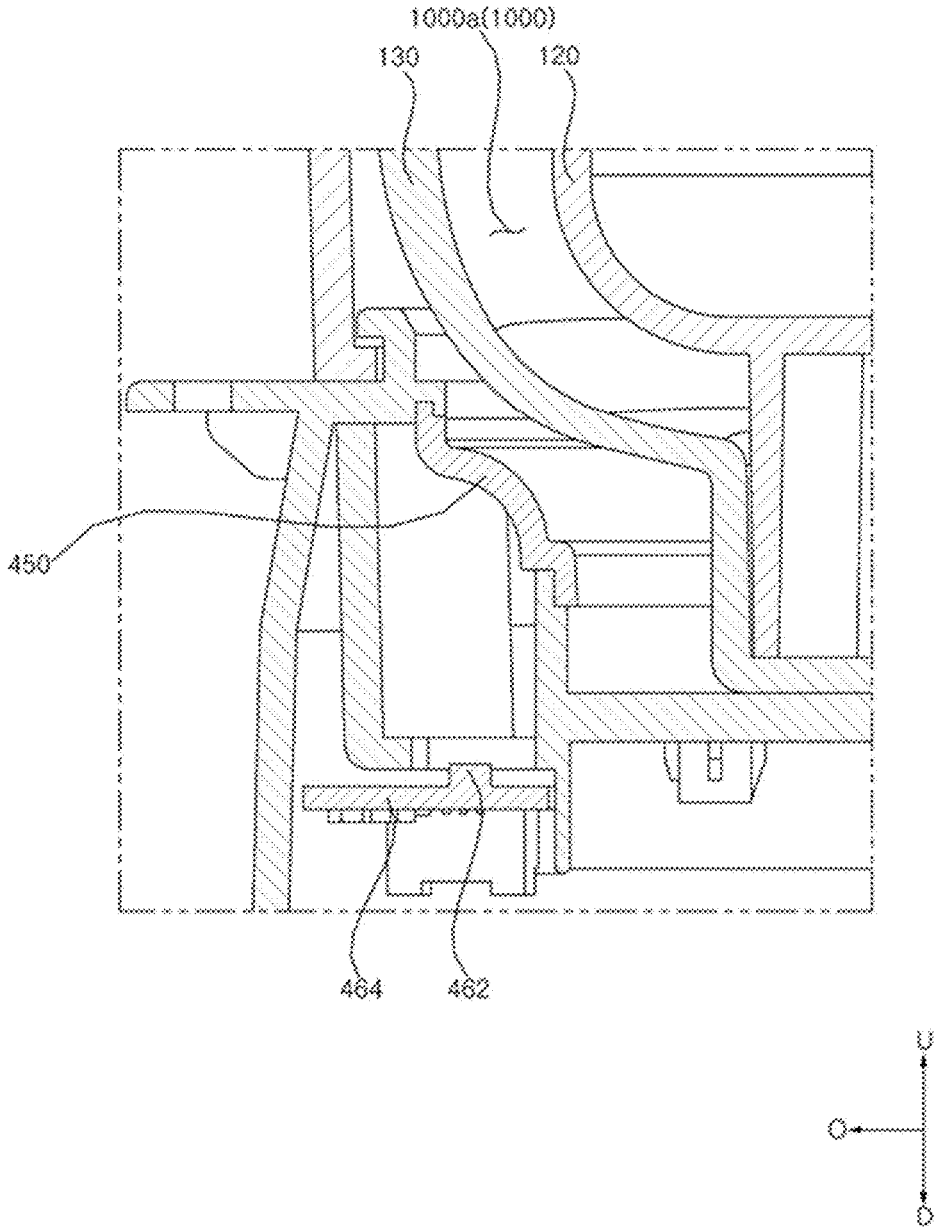
FIG. 28 is a cross-sectional view of a light diffuser in a humidifier according to an embodiment.

Referring to FIG. 28, the light diffuser 450 in one implementation of humidifier 1 may be formed to be convex. For example, a surface of the light diffuser 450 may be formed to be convex. In one example, the diffuser slope 452 may be formed to be convex upward. The surface of the light diffuser 450 may be formed to be convex toward the first discharge flow path 1000*a*. The surface of the light diffuser 450 may be formed to convex toward the inner shell 130. For example, the surface of the light diffuser 450 may be formed to be convex upward in the center direction.

Referring to FIGS. 1 to 28, a humidifier according to one aspect of the present disclosure may include: a case; a humidifying device which is disposed inside the case, and generates humidified air; a light source which is disposed inside the case, and emits light; and a light diffuser which diffuses the light emitted from the light source, wherein the case may include: a peripheral wall; and a discharge flow path which extends in an up-down direction from an inner side of the peripheral wall, and is located in an upper side of the humidifying device, wherein in the peripheral wall, at least a portion corresponding to a vertical location of the discharge flow path is transparent, wherein the light source is disposed in a lower side of the discharge flow path, wherein the light diffuser is disposed between the light source and the discharge flow path, and extends downward in a center direction of the case.

According to another aspect of the present disclosure, the light source may include a plurality of light sources disposed to be spaced apart from each other in a circumferential direction of cross section of the discharge flow path, and the light diffuser extends in the circumferential direction of the cross section of the discharge flow path. According to another aspect of the present disclosure, the light diffuser may include a diffuser slope inclined downward in a center direction of the discharge flow path, and the plurality of light sources are located in a lower side of the diffuser slope.

According to another aspect of the present disclosure, the humidifier further may include a middle cover which extends in the circumferential direction of the cross section of the discharge flow path, and covers the plurality of light sources, and the middle cover is connected to the light diffuser. According to another aspect of the present disclosure, the middle cover may include: an outer peripheral wall surrounding the side surface of the plurality of light sources; and an upper wall extending from the upper end of the outer peripheral wall toward the water tank.

According to another aspect of the present disclosure, a connection portion where the middle cover and the light diffuser are connected is located further out in a horizontal direction than the light source. According to another aspect of the present disclosure, the water tank is formed of a light reflective material.

According to another aspect of the present disclosure, the case may include: a water tank which is disposed in an upper side of the humidifying device inside the case; an outer shell which is spaced radially outwards from the water tank, and opened upward; and an inner shell which is disposed inside the outer shell, and in which the water tank is accommodated, and the discharge flow path may include: a first discharge flow path which is formed between the water tank and the inner shell, and through which humidified air flows; and a second discharge flow path formed between the inner shell and the outer shell.

According to another aspect of the present disclosure, the light source and the light diffuser are disposed in a lower side of the first discharge flow path. According to another aspect of the present disclosure, the outer shell may include: a first outer shell formed to be transparent; and a second outer shell which extends upward from the first outer shell, and has an open upper side.

According to another aspect of the present disclosure, the inner shell is transparent. According to another aspect of the present disclosure, the humidifier further may include a water tank housing which is disposed between the water tank and the inner shell, and in which the water tank is accommodated, and the water tank housing is transparent.

According to another aspect of the present disclosure, the light diffuser is spaced upward from the light source based on an up-down direction. According to another aspect of the present disclosure, the separation distance between the light diffuser and the light source in the up-down direction may be in the range of 12 to 14 mm. According to another aspect of the present disclosure, the first outer shell is spaced upward from the light diffuser.

According to another aspect of the present disclosure, a slope of a virtual first straight line connecting a lower end of the first outer shell and an upper end of the light diffuser is smaller than a slope of a virtual second straight line which connects the upper end and a lower end of the light diffuser, and is located on the same plane as the first straight line.

According to another aspect of the present disclosure, the humidifier further may include a barrier wall which is spaced radially outwards from the inner shell, and extends in an up-down direction, wherein an upper end of the barrier wall is located below an upper end of the first outer shell, and located above the light diffuser. According to another aspect of the present disclosure, a virtual third straight line connecting the upper end of the first outer shell and the upper end of the barrier wall may be located in the upper side of the light diffuser.

Referring to FIGS. 1 to 28, the humidifier according to one aspect of the present disclosure may include: a case; a humidifying device which is disposed inside the case, and generates humidified air; and a light source which is disposed inside the case, and emits light, wherein the case may include: an outer shell disposed in an upper side of the humidifying device; and a discharge flow path formed inside the outer shell, wherein the outer shell may include: a first outer shell formed to be transparent; and a second outer shell which extends upward from the first outer shell, and has an open upper side, wherein the light source is disposed in a lower side of the discharge flow path, and spaced in a radial direction from a center of the case, wherein the first outer shell is spaced upward from the light source.

According to another aspect of the present disclosure, the humidifier further may include a barrier wall which is spaced in the radial direction from the center of the case, and extends in a circumferential direction of a cross section of the discharge flow path, wherein the barrier wall is located further out in a horizontal direction than the light source, wherein an upper end of the barrier wall is located above the light source.

According to another aspect of the present disclosure, a virtual third straight line connecting an upper end of the first outer shell and an upper end of the barrier wall is located in an upper side of the light source. According to another aspect of the present disclosure, the humidifier further may include a light diffuser which covers the light source, and diffuses the light emitted from the light source.

According to another aspect of the present disclosure, a virtual third straight line connecting an upper end of the first outer shell and an upper end of the barrier wall is located in an upper side of the light diffuser. According to another aspect of the present disclosure, the distance of the light source from the center of the case in the horizontal direction may be longer than the distance of the light source from the inner wall of the case in the horizontal direction.

Referring to FIGS. 1 to 28, the humidifier according to one aspect of the present disclosure may include: a case; a humidifying device which is disposed inside the case, and generates humidified air; a water tank which is disposed in an upper side of the humidifying device inside the case; and a light source which is disposed inside the case and emits light, wherein the case may include: an outer shell which is spaced radially outwards from the water tank, and opened upward; and a discharge flow path which extends in an up-down direction between the water tank and the outer shell, and has a circular cross-section, wherein in the outer shell, at least a portion corresponding to a vertical location of the discharge flow path is transparent, wherein the light source is disposed in a lower side of the discharge flow path, and irradiates light toward the discharge flow path.

According to at least one of the embodiments of the present disclosure, since the light diffuser faces inward, light emitted from the light source may not be directly illuminated into the indoor space. According to at least one of the embodiments of the present disclosure, the light source and the light diffuser are disposed in the lower side of the discharge flow path, so that light may be transmitted to the indoor space through humidified air flowing through the discharge flow path.

According to at least one of the embodiments of the present disclosure, due to the middle cover covering the light source, light emitted from the light source propagates only through the light diffuser, and the middle cover can prevent the light from traveling in an outward direction. According to at least one of the embodiments of the present disclosure, due to the water tank formed of a reflective material, light can travel far through the discharge flow path.

According to at least one of the embodiments of the present disclosure, the light diffuser is disposed in the lower side of the first discharge flow path through which humidified air flows and illuminates the humidified air, so that occupants can determine the operating state of the humidifier through the flow of humidified air even in a dark space. According to at least one of the embodiments of the present disclosure, due to the light diffuser being spaced upward from the light source, light condensation phenomenon may be reduced, thereby improving convenience of use for occupants.

According to at least one of the embodiments of the present disclosure, due to the first outer shell spaced upward from the light diffuser, the light emitted from the light diffuser is not directly exposed to the occupant's field of view, thereby improving convenience of use for occupants. According to at least one of the embodiments of the present disclosure, the light source and the light diffuser are not directly exposed to the user's viewing angle, thereby improving convenience of use for occupants.

According to at least one of the embodiments of the present disclosure, due to the light source disposed in the lower side of the annular discharge flow path, the humidifier can transmit light uniformly in all directions. The disclosure has been made in view of the above considerations and may provide a humidifier in which humidified air emits light to an indoor space.

The disclosure may further provide a humidifier that provides indirect light to occupants. The disclosure may further provide a humidifier with improved ease of use for occupants. The disclosure may further provide a humidifier that allows occupants to check the operating state in a dark space. The disclosure may further provide a humidifier that allows a user to check the operating state from a distance. The disclosure may further provide a humidifier that does not disturb the sleep of occupants. The disclosure may further provide a humidifier that illuminates light uniformly in all directions.

In accordance with an aspect of the present disclosure, a humidifier may include: a case; a humidifying device which is disposed inside the case, and generates humidified air; a light source which is disposed inside the case, and emits light; and a light diffuser which diffuses the light emitted from the light source, wherein the case comprises: a peripheral wall; and a discharge flow path which extends in an up-down direction from an inner side of the peripheral wall, and is located in an upper side of the humidifying device, wherein in the peripheral wall, at least a portion corresponding to a vertical location of the discharge flow path is transparent, wherein the light source is disposed in a lower side of the discharge flow path, wherein the light diffuser is disposed between the light source and the discharge flow path, and extends downward in a center direction of the case, so that the light diffuser can prevent light emitted from the light source from proceeding directly outward. In addition, the light diffuser can illuminate the humidified air flowing through the discharge flow path.

The light source may include a plurality of light sources disposed to be spaced apart from each other in a circumferential direction of cross section of the discharge flow path, and the light diffuser extends in the circumferential direction of the cross section of the discharge flow path, thereby supplying uniform light along the circumference.

The light diffuser may include a diffuser slope inclined downward in a center direction of the discharge flow path, and the plurality of light sources are located in a lower side of the diffuser slope, so that the diffuser slope can transmit light upward in the center direction. The humidifier further may include a middle cover which extends in the circumferential direction of the cross section of the discharge flow path, and covers the plurality of light sources, and the middle cover is connected to the light diffuser, so that light emitted from the light source can only be transmitted through the light diffuser.

The middle cover may include: an outer peripheral wall surrounding the side surface of the plurality of light sources; and an upper wall extending from the upper end of the outer peripheral wall toward the water tank, so that light emitted from the light source may not proceed directly to the outside.

A connection portion where the middle cover and the light diffuser are connected is located further out in a horizontal direction than the light source, so that the light emitted from the light source not only proceeds upward in the center direction, but also proceeds to the upper side. The water tank is formed of a light reflective material, so that light that passed through the light diffuser may proceed to the upper side while being reflected in the water tank.

The case may include: a water tank which is disposed in an upper side of the humidifying device inside the case; an outer shell which is spaced radially outwards from the water tank, and opened upward; and an inner shell which is disposed inside the outer shell, and in which the water tank is accommodated, wherein the discharge flow path may include: a first discharge flow path which is formed between the water tank and the inner shell, and through which humidified air flows; and a second discharge flow path formed between the inner shell and the outer shell. The light source and the light diffuser are disposed in a lower side of the first discharge flow path, thereby illuminating humidified air.

The outer shell may include: a first outer shell formed to be transparent; and a second outer shell which extends upward from the first outer shell, and has an open upper side, so that a user can visually check the humidified air illuminated through the first outer shell. The inner shell is transparent, so that a user can visually check the humidified air illuminated through the inner shell.

The humidifier further may include a water tank housing which is disposed between the water tank and the inner shell, and in which the water tank is accommodated, and the water tank housing is transparent, so that light may pass through the transparent water tank housing and be reflected by the water tank. The light diffuser is spaced upward from the light source based on an up-down direction, thereby minimizing light condensation phenomenon. The first outer shell may be spaced upward from the light diffuser, so that the light diffuser through which light is emitted may not exist in the user's field of view.

A slope of a virtual first straight line connecting a lower end of the first outer shell and an upper end of the light diffuser may be smaller than a slope of a virtual second straight line which connects the upper end and a lower end of the light diffuser, and is located on the same plane as the first straight line, so that the light source and the light diffuser may not be directly exposed to the user's viewing angle.

The humidifier further may include a barrier wall which is spaced radially outwards from the inner shell, and extends in an up-down direction, and an upper end of the barrier wall is located below an upper end of the first outer shell, and located above the light diffuser, so that the barrier wall can prevent light emitted from the light diffuser from propagating directly through the first outer shell. The virtual third straight line connecting the upper end of the first outer shell and the upper end of the barrier wall is located in the upper side of the light diffuser, so that the light diffuser may not be directly exposed even at the user's maximum viewing angle. Since the separation distance of the light source from the center of the case in the horizontal direction is longer than the separation distance of the light source from the inner wall of the case in the horizontal direction, the light source is disposed adjacent to the inner wall of the case, so that the irradiation range of the light emitted from the light source can be focused inward.

In accordance with another aspect of the present disclosure, a humidifier may include: a case; a humidifying device which is disposed inside the case, and generates humidified air; a water tank which is disposed in an upper side of the humidifying device inside the case; and a light source which is disposed inside the case and emits light, wherein the case may include: an outer shell which is spaced radially outwards from the water tank, and opened upward; and a discharge flow path which extends in an up-down direction between the water tank and the outer shell, and has a circular cross-section, wherein in the outer shell, at least a portion corresponding to a vertical location of the discharge flow path is transparent, wherein the light source is disposed in a lower side of the discharge flow path, and irradiates light toward the discharge flow path, so that the light source can transmit light in all directions through humidified air flowing through an annular discharge flow path.

Certain embodiments or other embodiments of the invention described above are not mutually exclusive or distinct from each other. Any or all elements of the embodiments of the invention described above may be combined or combined with each other in configuration or function.

For example, a configuration "A" described in one embodiment of the invention and the drawings and a configuration "B" described in another embodiment of the invention and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments may be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A humidifier, comprising:

a case;

a humidifying device that is disposed inside the case and is configured to generate humidified air;

a light source that is disposed inside the case and that emits light; and a light diffuser that is positioned to defuse at least a portion of the light emitted from the light source, wherein the case includes:

a peripheral wall; and a discharge flow path that extends vertically radially inside of the peripheral wall and is located above the humidifying device, wherein at least a portion of the peripheral wall corresponds to a vertical location of the discharge flow path and is transparent, wherein the light source is disposed below the discharge flow path, and wherein the light diffuser is disposed between the light source and the discharge flow path, and at least a portion of the light diffuser extends downward toward a center of the case.

2. The humidifier of claim 1, wherein the light source includes a plurality of light sources that are spaced apart from each other in a circumferential direction of a cross section of the discharge flow path, and wherein the light diffuser extends in the circumferential direction of the cross section of the discharge flow path.

3. The humidifier of claim 2, wherein the light diffuser comprises a diffuser sloped wall that is inclined downward toward a center of the discharge flow path, and wherein the plurality of light sources are located below the diffuser sloped wall.

4. The humidifier of claim 2, further comprising a middle cover that extends in the circumferential direction of the cross section of the discharge flow path covers the plurality of light sources, wherein the middle cover is connected to the light diffuser.

5. The humidifier of claim 4, wherein a connection location of the middle cover and the light diffuser is further out in a horizontal direction from the center of the case than the light source.

6. The humidifier of claim 1, wherein the case includes:

a water tank that is disposed above the humidifying device and inside the case, the water tank holding water provided to the humidifying device;

an outer shell that is spaced radially outwards from the water tank and is opened upward; and an inner shell which is disposed radially inside the outer shell and in which the water tank is accommodated, wherein the discharge flow path comprises:

a first discharge flow path which is defined between the water tank and the inner shell and through which the humidified air flows from the humidifying device; and a second discharge flow path that is defined between the inner shell and the outer shell.

7. The humidifier of claim 6, wherein the light source and the light diffuser are disposed below the first discharge flow path.

8. The humidifier of claim 6, wherein the outer shell comprises:

a first outer shell that is transparent; and a second outer shell that extends upward from the first outer shell and that has an open upper side.

9. The humidifier of claim 6, wherein the inner shell is transparent.

10. The humidifier of claim 9, further comprising a water tank housing which is disposed between the water tank and the inner shell, and in which the water tank is accommodated, wherein the water tank housing is transparent.

11. The humidifier of claim 6, wherein the water tank is formed of a light reflective material.

12. The humidifier of claim 1, wherein the light diffuser is spaced upward from the light source.

13. The humidifier of claim 8, wherein the first outer shell is spaced upward from the light diffuser.

14. The humidifier of claim 13, wherein a slope of a virtual first straight line connecting a lower end of the first outer shell and an upper end of the light diffuser is smaller than a slope of a virtual second straight line which connects the upper end and a lower end of the light diffuser, and the virtual first straight line and the virtual second straight line are located on a same plane.

15. The humidifier of claim 13, further comprising a barrier wall that is spaced radially outwards from the inner shell, and extends in a vertical direction, wherein an upper end of the barrier wall is located lower than an upper end of the first outer shell, and located higher than the light diffuser.

16. A humidifier, comprising:

a case;

a humidifying device that is disposed inside the case and is configured to generate humidified air; and a light source that is disposed inside the case and that emits light, wherein the case includes:

an outer shell provided above the humidifying device; and a discharge flow path defined inside the outer shell, wherein the outer shell includes:

a first outer shell that is transparent; and a second outer shell that extends upward from the first outer shell and has an open upper side, wherein the light source is provided below the discharge flow path and is spaced in a radial direction from a center of the case, and wherein the first outer shell is positioned to be spaced upward from the light source.

17. The humidifier of claim 16, further comprising a barrier wall that is spaced in the radial direction from the center of the case, and that extends in a circumferential direction of a cross section of the discharge flow path, wherein the barrier wall is located further out in a horizontal direction than the light source from the center of the case, and wherein an upper end of the barrier wall is located higher than the light source.

18. The humidifier of claim 17, wherein a virtual third straight line connecting an upper end of the first outer shell and the upper end of the barrier wall is located above the light source.

19. The humidifier of claim 17, further comprising a light diffuser that covers the light source and defuses the light emitted from the light source, wherein a virtual third straight line that connects an upper end of the first outer shell and the upper end of the barrier wall is located above the light diffuser.

20. A humidifier, comprising:

a case;

a humidifying device that is disposed inside the case and is configured to generate humidified air;

a water tank that is disposed above the humidifying device and inside the case; and a light source that is disposed inside the case and that emits light, wherein the case includes:

an outer shell that is spaced radially outwards from the water tank and is opened upward; and a discharge flow path that extends in a vertical direction between the water tank and the outer shell, and has a circular cross-section, wherein at least a portion of the outer shell that corresponds to a vertical location of the discharge flow path is transparent, and wherein the light source is positioned below the discharge flow path and irradiates light toward the discharge flow path.

* * * * *